US009415985B1

(12) United States Patent
Zuckerman

(10) Patent No.: US 9,415,985 B1
(45) Date of Patent: Aug. 16, 2016

(54) METHOD FOR LIFTING WITH MAST COLLISION CONTROL APPARATUS

(71) Applicant: Raymond S. Zuckerman, Scottsdale, AZ (US)

(72) Inventor: Raymond S. Zuckerman, Scottsdale, AZ (US)

(73) Assignee: SERVERLIFT CORPORATION, Phoenix, AZ (US)

( * ) Notice: Subject to any disclaimer, the term of this patent is extended or adjusted under 35 U.S.C. 154(b) by 0 days.

(21) Appl. No.: 14/809,005

(22) Filed: Jul. 24, 2015

Related U.S. Application Data

(63) Continuation of application No. 13/567,027, filed on Aug. 4, 2012, now Pat. No. 9,090,432.

(51) Int. Cl.

| | |
|---|---|
| ***B66F 9/06*** | (2006.01) |
| ***B66F 9/20*** | (2006.01) |
| ***B66B 9/16*** | (2006.01) |
| ***B66B 9/04*** | (2006.01) |
| ***B66F 17/00*** | (2006.01) |
| ***B66F 9/07*** | (2006.01) |

(52) U.S. Cl.
CPC ..... *B66F 17/003* (2013.01); *B66B 9/16* (2013.01); *B66F 9/07* (2013.01); *B66F 9/20* (2013.01); *B66B 9/04* (2013.01)

(58) Field of Classification Search
CPC ..... B66F 9/20; B66F 17/003; B66F 9/06; B66B 9/16
USPC ..... 701/218; 187/223, 224, 226, 230, 238; 414/275, 347, 486, 540, 629, 631, 663, 414/668, 674
See application file for complete search history.

(56) References Cited

U.S. PATENT DOCUMENTS

| | | | | |
|---|---|---|---|---|
| 3,269,783 | A * | 8/1966 | Kriz | B60Q 9/003 180/275 |
| 3,941,213 | A | 3/1976 | Stammen | |
| 4,074,787 | A * | 2/1978 | Cunningham | B60T 7/12 180/271 |
| 4,156,865 | A * | 5/1979 | Lovell | B60Q 9/003 200/61.42 |
| 4,598,797 | A | 7/1986 | Schultz | |
| 4,635,982 | A * | 1/1987 | Feldmann | B60T 7/22 180/275 |
| 4,869,639 | A | 9/1989 | Wikstrom | |
| 4,979,588 | A * | 12/1990 | Pike | B66F 11/046 182/18 |

(Continued)

FOREIGN PATENT DOCUMENTS

| | | |
|---|---|---|
| DE | 102004047212 A1 | 4/2006 |
| EP | 509659 | 7/1995 |

(Continued)

*Primary Examiner* — William A Rivera
*Assistant Examiner* — Stefan Kruer
(74) *Attorney, Agent, or Firm* — Michael W. Goltry; Robert A. Parsons; Parsons & Goltry

(57) ABSTRACT

A lift device includes a lifting mast having a top, and a drive assembly for moving the lifting mast in lifting and lowering directions. A head is positioned above and over the top of the lifting mast, and is mounted to the lifting mast for displacement between a neutral position and a safe position with respect to the lifting mast in response to the head contact encountering an object above the top of the lifting mast and the head. The drive assembly is enabled for moving of the lifting mast in the lifting and lowering directions in the neutral position of the head, the drive assembly is enabled for moving the lifting mast in the lowering direction in the safe position of the head, and the drive assembly is disabled for moving the lifting mast in the lifting direction in the safe position of the head.

4 Claims, 22 Drawing Sheets

(56) References Cited

U.S. PATENT DOCUMENTS

| | | | | |
|---|---|---|---|---|
| 5,213,383 | A * | 5/1993 | Muselli | B25J 5/007 180/275 |
| 5,424,713 | A * | 6/1995 | Thompson | B60Q 1/52 200/61.44 |
| 5,906,648 | A | 5/1999 | Zoratti et al. | |
| 6,032,992 | A * | 3/2000 | He | B60T 7/22 180/275 |
| 7,194,358 | B2 | 3/2007 | Callaghan et al. | |
| 9,090,432 | B2 * | 7/2015 | Zuckerman | B66B 9/16 |
| 2003/0235490 | A1 | 12/2003 | Dale et al. | |
| 2007/0007080 | A1 * | 1/2007 | Manthey | B66F 9/24 187/224 |
| 2011/0280700 | A1 * | 11/2011 | Uttech | A61G 7/1019 414/540 |

FOREIGN PATENT DOCUMENTS

| | | | |
|---|---|---|---|
| EP | 2468678 | A1 | 6/2012 |
| GB | 2116518 | A | 9/1983 |

* cited by examiner

METHOD FOR LIFTING WITH MAST COLLISION CONTROL APPARATUS

FIELD OF THE INVENTION

The present invention relates generally to lifts with lifting masts that move in lifting and lowering directions and, more particularly, to lifting mast collision control systems for ensuring the safe movement of a lifting mast in lifting and lowering directions for safeguarding against damage to cargo to be lifted and lowered by the lifting mast.

BACKGROUND OF THE INVENTION

Lift devices are commonly used to lift workers and equipment during construction, painting, maintenance, assembly, installation, and manufacturing operations. Of particular significance are lifts incorporating lifting masts the move in lifting and lowering directions for lifting and lowering loads supported by the lifting mast, such as on a platform or other load-supporting structure or implement managed by the lifting mast. When a lift incorporating such a lifting mast is being operated near overhead obstructions, such as overhead fixtures, equipment, ducts, rafters, ceilings, or the like, operator error or miscalculation can result in the top of the lifting mast encountering an overhead obstruction, which can cause damage to the lift and/or to the load borne by the lifting mast. What is therefore needed is a lifting mast collision control system that controls the operation of the lifting mast for ensuring the safe operation of the lifting mast against collision of the lifting mast with an overhead obstruction.

SUMMARY OF THE INVENTION

According to the principle of the invention a lift device includes a lifting mast having a top, and a drive assembly for moving the lifting mast in lifting and lowering directions. A head is positioned above and over the top of the lifting mast, and is mounted to the lifting mast for displacement between a neutral position away from the top of the lifting mast and a safe position toward the top of the lifting mast in response to the head contact encountering an object above the top of the lifting mast and the head. The drive assembly is enabled for moving of the lifting mast in the lifting and lowering directions in the neutral position of the head, the drive assembly is enabled for moving the lifting mast in the lowering direction in the safe position of the head, and the drive assembly is disabled for moving the lifting mast in the lifting direction in the safe position of the head. A bias is applied to the head tending to bias the head from the safe position to the neutral position. The bias is supplied by at least one spring interacting between the head and the lifting mast. The head is mounted to the lifting mast for displacement between the neutral and safe positions with a linkage assembly interacting between, or otherwise coupled between, the head and the lifting mast. The head covers the top of the lifting mast so as to shield the top of the lifting mast from directly contact encountering an object above the top of the lifting mast and the head.

According to the principle of the invention, a lift device includes a lifting mast having a top, and a drive assembly for moving the lifting mast in lifting and lowering directions. A head is positioned above and over the top of the lifting mast, and is mounted to the lifting mast for displacement between a neutral position away from the top of the lifting mast and a safe position toward the top of the lifting mast in response to the head contact encountering an object above the top of the lifting mast and the head. A switch is operatively coupled to the drive assembly. The switch interacts between the head and the lifting mast enabling the drive assembly for moving the lifting mast in the lifting and lowering directions in the neutral position of the head, disabling the drive assembly for moving the lifting mast in the lifting direction in the safe position of the head, and enabling the drive assembly for moving the lifting mast in the lowering direction in the safe position of the head. A bias is applied to the head tending to bias the head from the safe position to the neutral position. The bias is supplied by at least one spring interacting between the head and the lifting mast. The head is mounted to the lifting mast for displacement between the neutral and safe positions with a linkage assembly interacting between, or otherwise coupled between, the head and the lifting mast. The head covers the top of the lifting mast so as to shield the top of the lifting mast from directly contact encountering an object above the top of the lifting mast and the head.

According to the principle of the invention, a lift device includes a lifting mast having a top, and a drive assembly for moving the lifting mast in lifting and lowering directions. A base is removably coupled to the top of the lifting mast. A head is positioned above and over the base and the top of the lifting mast, and is mounted to the base for displacement between a neutral position away from the base and the top of the lifting mast and a safe position toward the base and the top of the lifting mast in response to the head contact encountering an object above the base and the top of the lifting mast. The drive assembly is enabled for moving of the lifting mast in the lifting and lowering directions in the neutral position of the head, the drive assembly is enabled for moving the lifting mast in the lowering direction in the safe position of the head, and the drive assembly is disabled for moving the lifting mast in the lifting direction in the safe position of the head. A bias is applied to the head tending to bias the head from the safe position to the neutral position. The bias is supplied by at least one spring interacting between the head and the base. The head is mounted to the base for displacement between the neutral and safe positions with a linkage assembly interacting between, or otherwise coupled between, the head and the base. The head covers the base and the top of the lifting mast so as to shield the base and the top of the lifting mast from directly contact encountering an object above the base and the top of the lifting mast.

According to the principle of the invention, a lift device includes a lifting mast having a top, and a drive assembly for moving the lifting mast in lifting and lowering directions. A base is removably coupled to the top of the lifting mast. A head is positioned above and over the base and the top of the lifting mast, and is mounted to the base for displacement between a neutral position away from the base and the top of the lifting mast and a safe position toward the base and the top of the lifting mast in response to the head contact encountering an object above the base and the top of the lifting mast. A switch is operatively coupled to the drive assembly. The switch interacts between the head and the base enabling the drive assembly for moving the lifting mast in the lifting and lowering directions in the neutral position of the head, disabling the drive assembly for moving the lifting mast in the lifting direction in the safe position of the head, and enabling the drive assembly for moving the lifting mast in the lowering direction in the safe position of the head. A bias is applied to the head tending to bias the head from the safe position to the neutral position. The bias is supplied by at least one spring interacting between the head and the base. The head is mounted to the base for displacement between the neutral and safe positions with a linkage assembly interacting between, or otherwise coupled between, the head and the base. The head covers the base and the top of the lifting mast so as to shield the base and the top of the lifting mast from directly contact encountering an object above the base and the top of the lifting mast.

According to the principle of the invention, a lift device includes a lifting mast having a top, and a drive assembly for moving the lifting mast in lifting and lowering directions. A head is positioned above and over the top of the lifting mast, and is mounted to the lifting mast for displacement between a neutral position away from the top of the lifting mast and a safe position toward the top of the lifting mast in response to the head contact encountering an object above the top of the lifting mast and the head. A switch is operatively coupled to the drive assembly. An abutment is coupled between the head and the switch and is coupled to interact with the switch in response to movement of the head between the neutral and safe positions causing the switch to enable the drive assembly for moving the lifting mast in the lifting and lowering directions in the neutral position of the head, causing the switch to disable the drive assembly for moving the lifting mast in the lifting direction in the safe position of the head, and causing the switch to enable the drive assembly for moving the lifting mast in the lowering direction in the safe position of the head. A bias is applied to the head tending to bias the head from the safe position to the neutral position. The bias is supplied by at least one spring interacting between the head and the lifting mast. The head is mounted to the lifting mast for displacement between the neutral and safe positions with a linkage assembly interacting between, or otherwise coupled between, the head and the lifting mast. The head covers the top of the lifting mast so as to shield the top of the lifting mast from directly contact encountering an object above the top of the lifting mast and the head.

According to the principle of the invention, a lift device includes a lifting mast having a top, and a drive assembly for moving the lifting mast in lifting and lowering directions. A base is removably coupled to the top of the lifting mast. A head is positioned above and over the base and the top of the lifting mast, and is mounted to the base for displacement between a neutral position away from the base and the top of the lifting mast and a safe position toward the base and the top of the lifting mast in response to the head contact encountering an object above the base and the top of the lifting mast. A switch is operatively coupled to the drive assembly. An abutment is coupled between, one the one hand, the head and the base, and, on the other hand, the switch, and the abutment is coupled to interact with the switch in response to movement of the head between the neutral and safe positions causing the switch to enable the drive assembly for moving the lifting mast in the lifting and lowering directions in the neutral position of the head, causing the switch to disable the drive assembly for moving the lifting mast in the lifting direction in the safe position of the head, and causing the switch to enable the drive assembly for moving the lifting mast in the lowering direction in the safe position of the head. A bias is applied to the head tending to bias the head from the safe position to the neutral position. The bias is supplied by at least one spring interacting between the head and the base. The head is mounted to the base for displacement between the neutral and safe positions with a linkage assembly interacting between, or otherwise coupled between, the head and the base. The head covers the base and the top of the lifting mast so as to shield the base and the top of the lifting mast from directly contact encountering an object above the base and the top of the lifting mast.

According to the principle of the invention, a lift device includes a lifting mast having a top, and a drive assembly for moving the lifting mast in lifting and lowering directions. A base is removably coupled to the top of the lifting mast. A head is positioned above and over the base and the top of the lifting mast, and is mounted to the base for displacement between a neutral position away from the base and the top of the lifting mast and a safe position toward the base and the top of the lifting mast in response to the head contact encountering an object above the base and the top of the lifting mast. A switch is carried by the base and is operatively coupled to the drive assembly. An abutment is coupled to the head, and is positioned to interact with the switch in response to movement of the head between the neutral and safe positions causing the switch to enable the drive assembly for moving the lifting mast in the lifting and lowering directions in the neutral position of the head, causing the switch to disable the drive assembly for moving the lifting mast in the lifting direction in the safe position of the head, and causing the switch to enable the drive assembly for moving the lifting mast in the lowering direction in the safe position of the head. A bias is applied to the head tending to bias the head from the safe position to the neutral position. The bias is supplied by at least one spring interacting between the head and the base. The head is mounted to the base for displacement between the neutral and safe positions with a linkage assembly interacting between, or otherwise coupled between, the head and the base. The head covers the base and the top of the lifting mast so as to shield the base and the top of the lifting mast from directly contact encountering an object above the base and the top of the lifting mast.

BRIEF DESCRIPTION OF THE DRAWINGS

Referring to the drawings.

DETAILED DESCRIPTION

Figure 1:
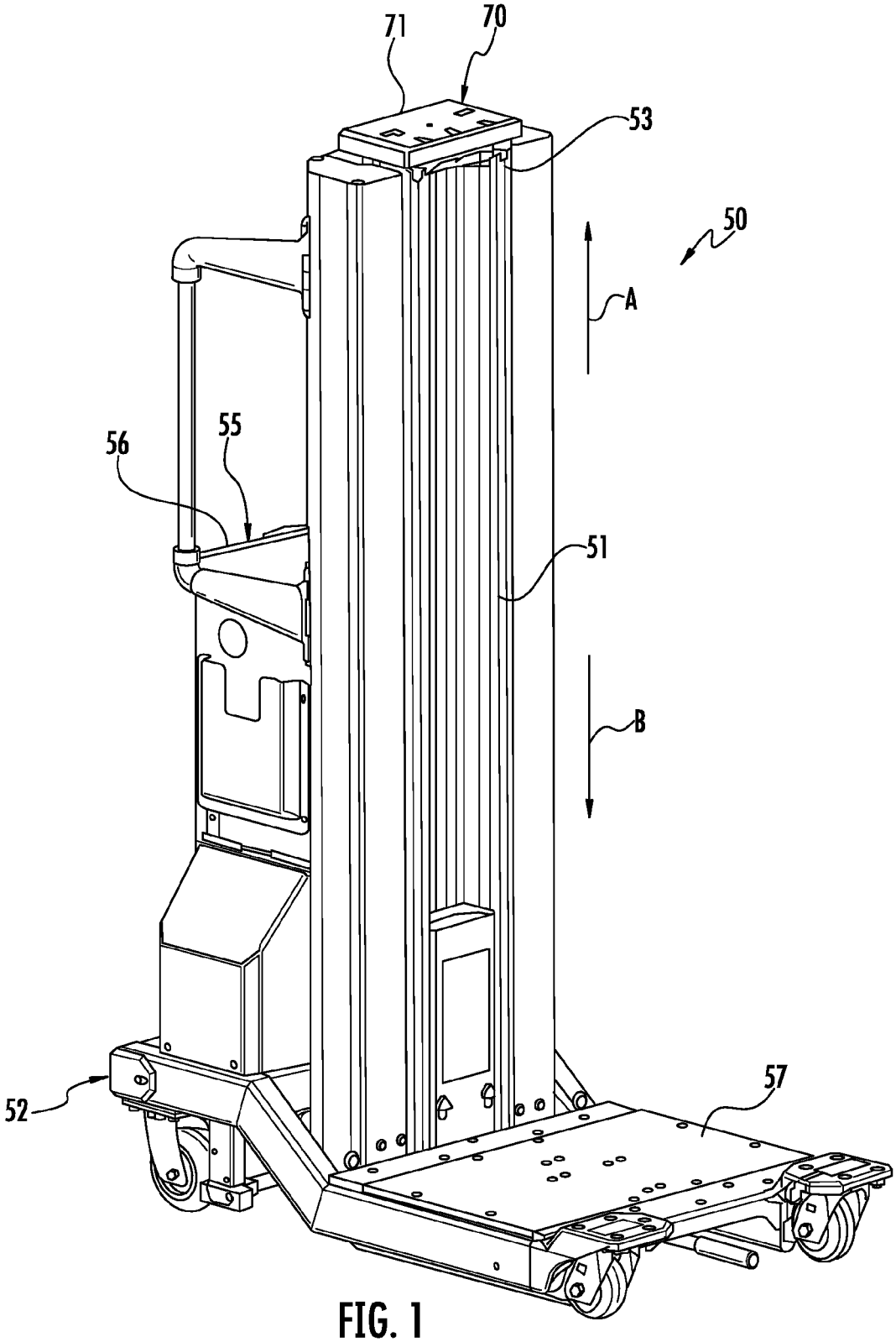
FIG. 1 is a front perspective view of a lift device including a lifting mast and a collision control apparatus that controls the operation of the lifting mast for ensuring the safe operation of the lifting mast against collision of the lifting mast with an overhead obstruction.
Figure 2:
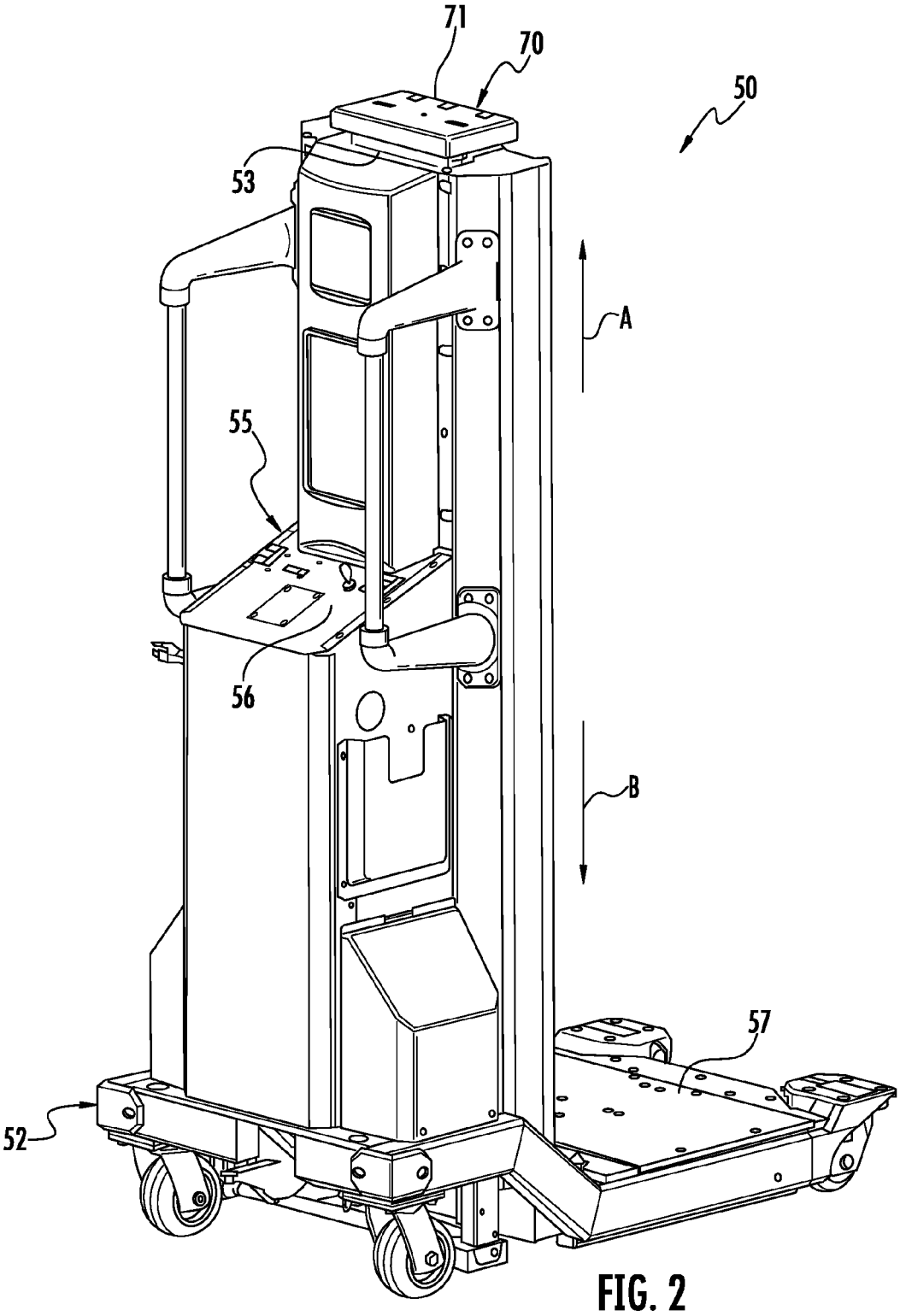
FIG. 2 is a rear perspective view of the embodiment of FIG. 1.
Figure 3:
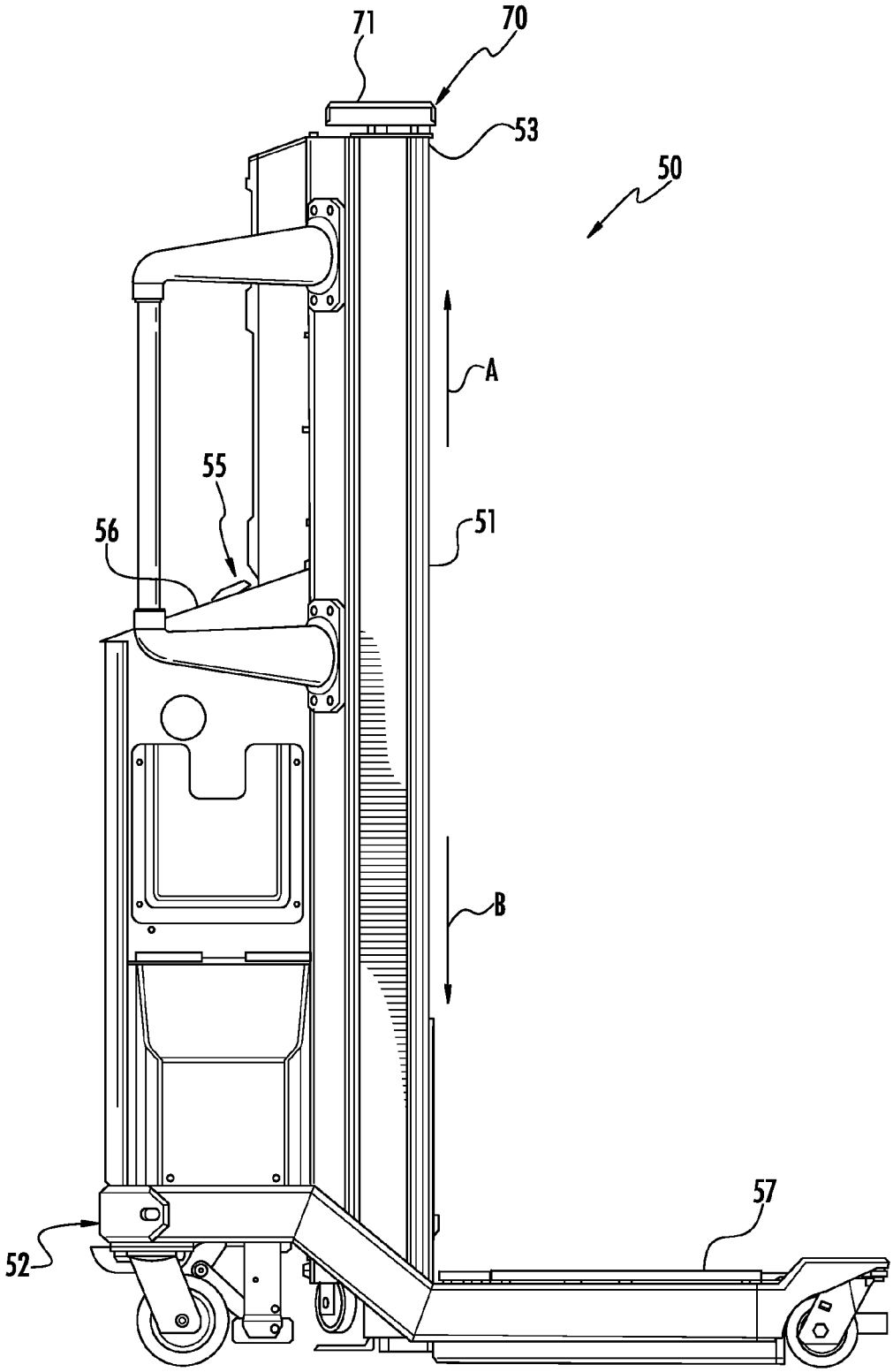
FIG. 3 is a side elevation view of the embodiment of FIG. 1.
Figure 17:
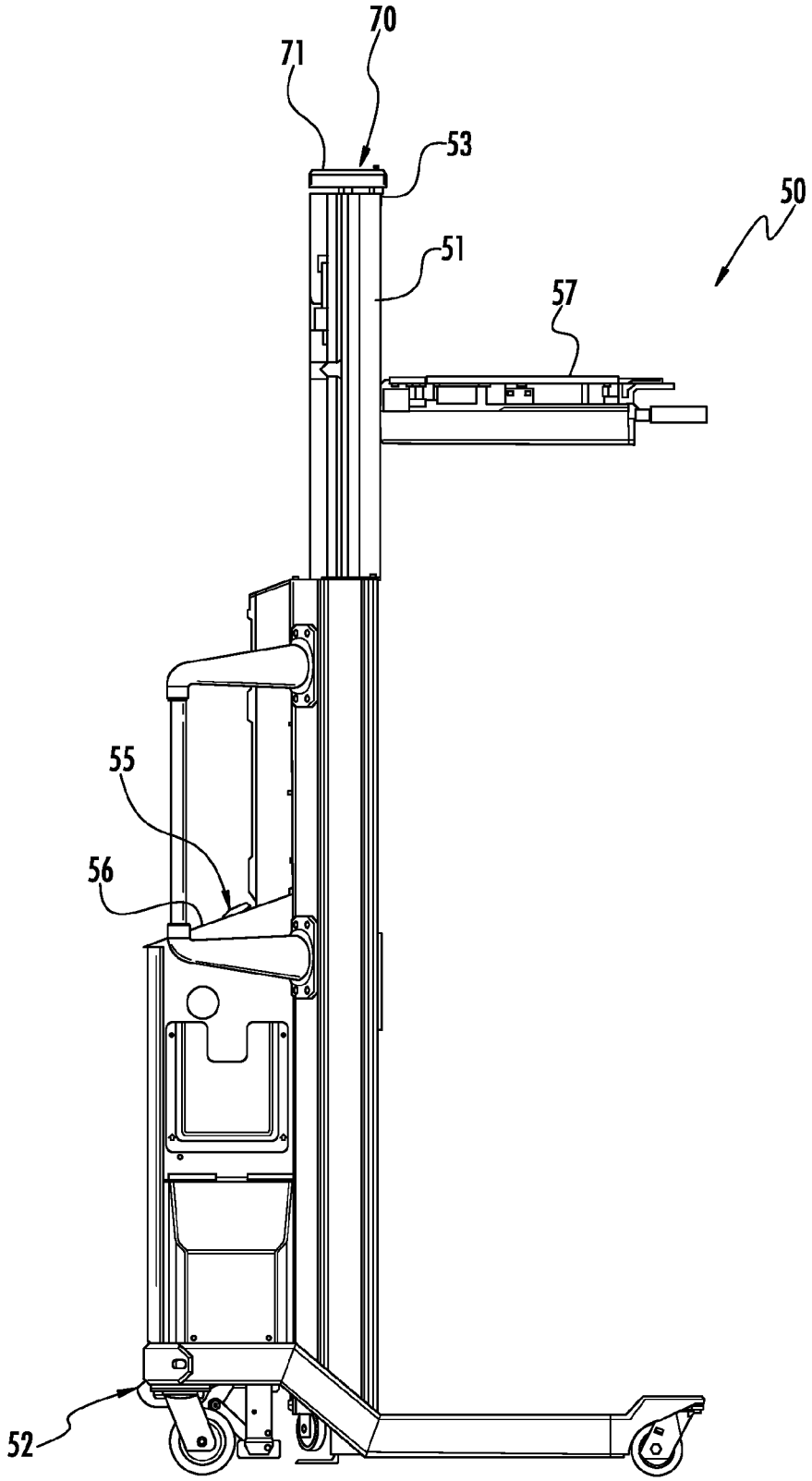
FIG. 17 is a side elevation view of the lift device of FIG. 1 illustrating the lifting mast as it would appear in a lifted or raised position and further illustrating an obstruction located above the collision control apparatus and the lifting mast.
Figure 19:
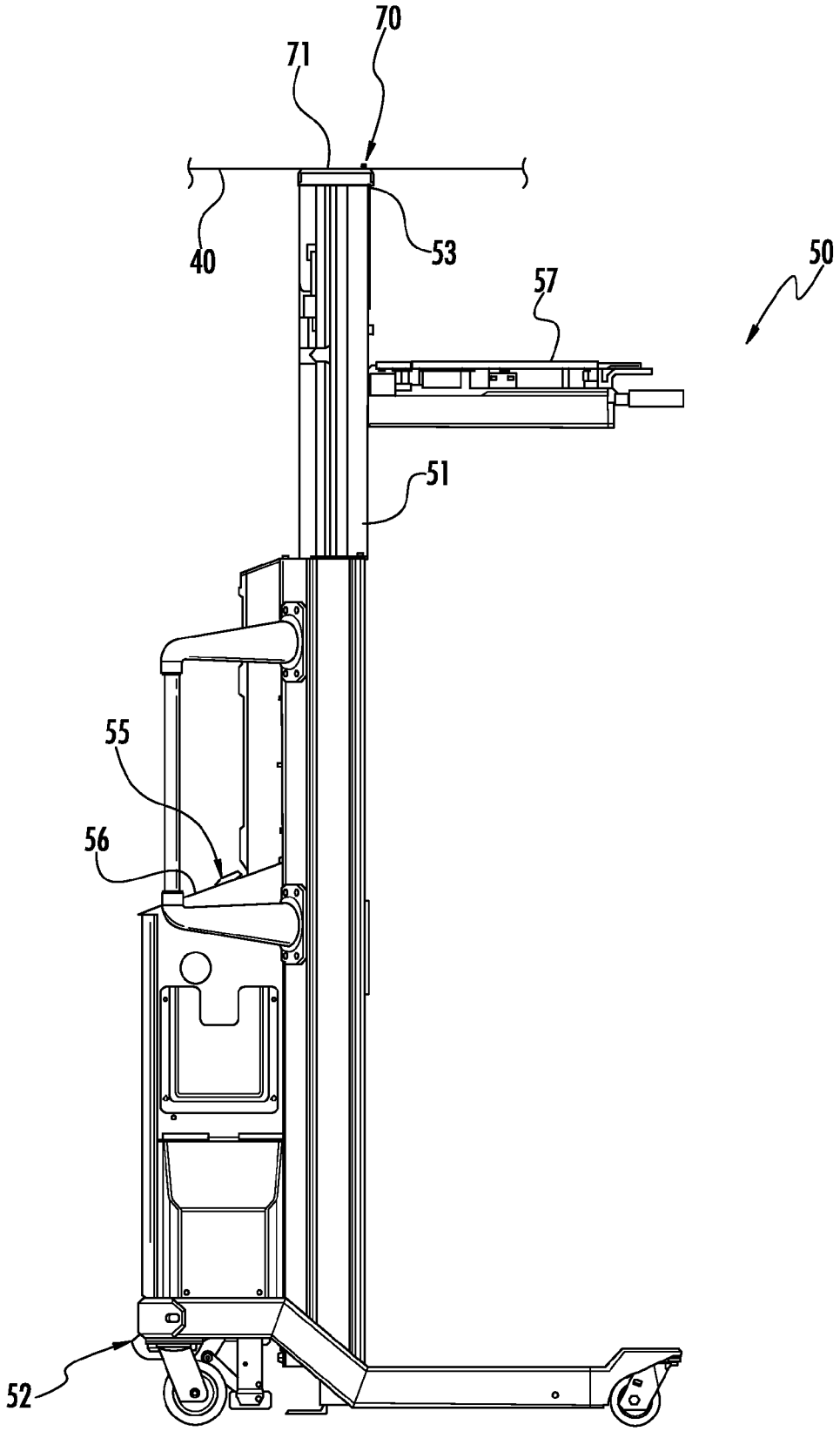
FIG. 19 is a side elevation view of the lift device similar to that of FIG. 17 illustrating the lifting mast as it would appear in a lifted or raised position and further illustrating an obstruction located above the collision control apparatus and the lifting mast and the obstruction is further shown as it would appear contact encountering and deflecting the collision control apparatus.

Turning now to the drawings, in which like reference characters indicate corresponding elements throughout the several views, attention is first directed to FIG. 1 illustrating a lift device 50 consisting of a lifting mast 51 mounted to a wheeled chassis 52 for reciprocal movement in lowering and raising/lifting directions between a lowered position or configuration as shown in FIG. 1, and a lifting, lifted or raised position or configuration as shown in FIGS. 17 and 19. Referencing FIG. 1, lifting mast 51 is a raising and lowering mast of lift device 50, and extends vertically upright to an upper end or top 53 at the extreme upper extremity of lift device 50. Lift device 51 incorporates a drive assembly denoted generally at 55 in FIGS. 1-3. Drive assembly 55 is not shown in detail and is an entirely conventional and well-known motorized drive assembly carried by wheeled chassis 52 and is conventionally operable for moving lifting mast 51 in the lifting or raising direction indicated by arrowed line A and the opposite lowering direction indicated by arrowed line B. Drive assembly 55 is operated by an operator interface in the form of a control panel 56, which is formed in the rear of wheeled chassis 52 of lift device 50. Drive assembly 55 incorporates a lifting circuit operable for engaging drive assembly 55 for moving lifting mast 51 in the raising direction in response operator control at control panel 56, and incorporates a lowering circuit operative for engaging drive assembly 55 for moving lifting mast 51 in the lowering direction in response to operator control at control panel 56. These lifting and lowering circuits are different from one another and are conventional and are activated in response to the operation of lift device 50 from control panel 56. A support fixture or platform 57 is attached to lifting mast 51, and movement of lifting mast 51 in the lifting and lowering directions between the raised and lowered positions of lifting mast 51 causes a corresponding movement of support platform 57 in lifting and lowering directions between a lowered position of support platform 57 in the lowered position of lifting mast 51 as shown in FIGS. 1-3 and a raised or lifted position of support platform 57 in the raised or lifted position of lifting mast 51 as shown in FIGS. 17 and 19 for facilitating the lifting and lowering of a load, such as equipment or material, placed on support platform 57. Wheeled chassis 52 is characterized in that it is formed with wheels 58 to permit wheeled movement of lift device 50 laterally across the ground, the floor, or other surface. Two or more of wheels 58 are steerable. The operation of lift device 50 is controlled by hand and from control panel 56, which permits movement of lifting mast 51 in the lowering and raising directions and which permits lift device 50 to be moved laterally according to the needs of the worker. Lift device 50 is generally representative of a conventional and well-known lifting device, further details of which will readily occur to the skilled artisan and will not be discussed in further detail.

Figure 4:
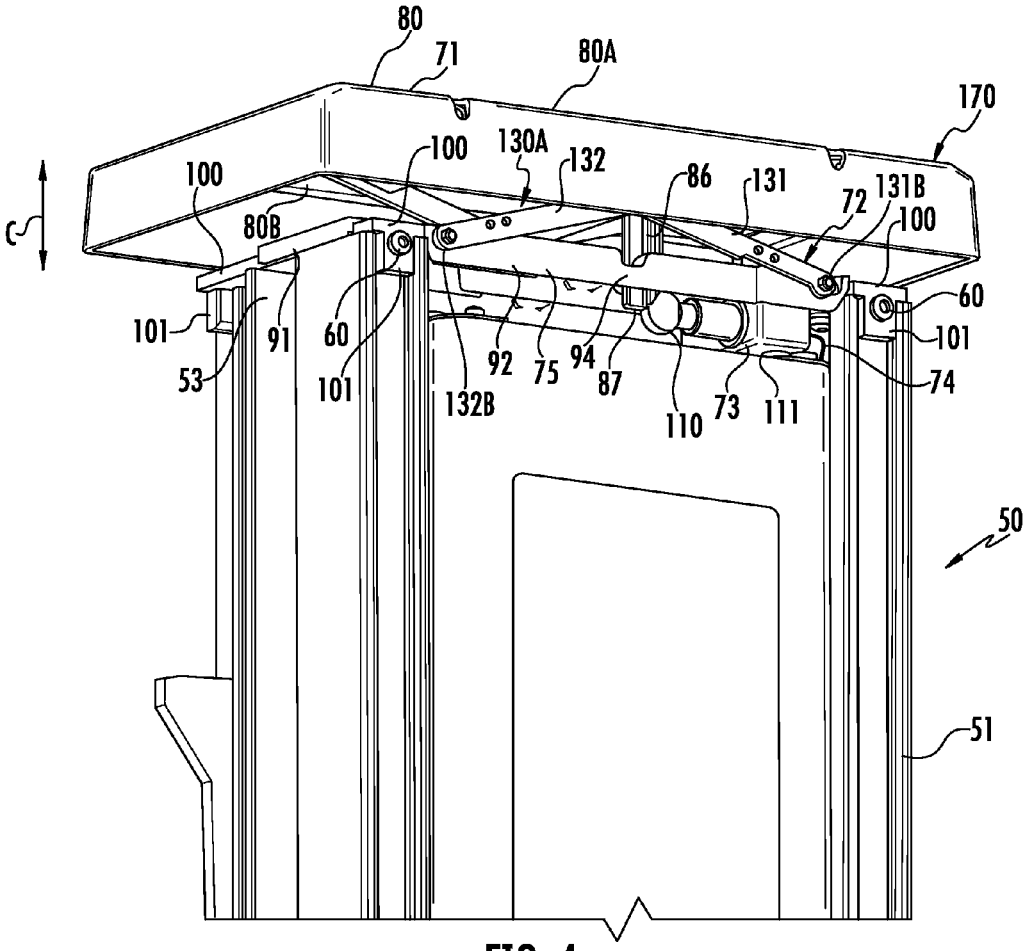
FIG. 4 is an enlarged fragmented view of the lifting mast of the lift of FIG. 1 shown incorporating the collision control apparatus illustrated as it would appear in a neutral configuration.
Figure 5:
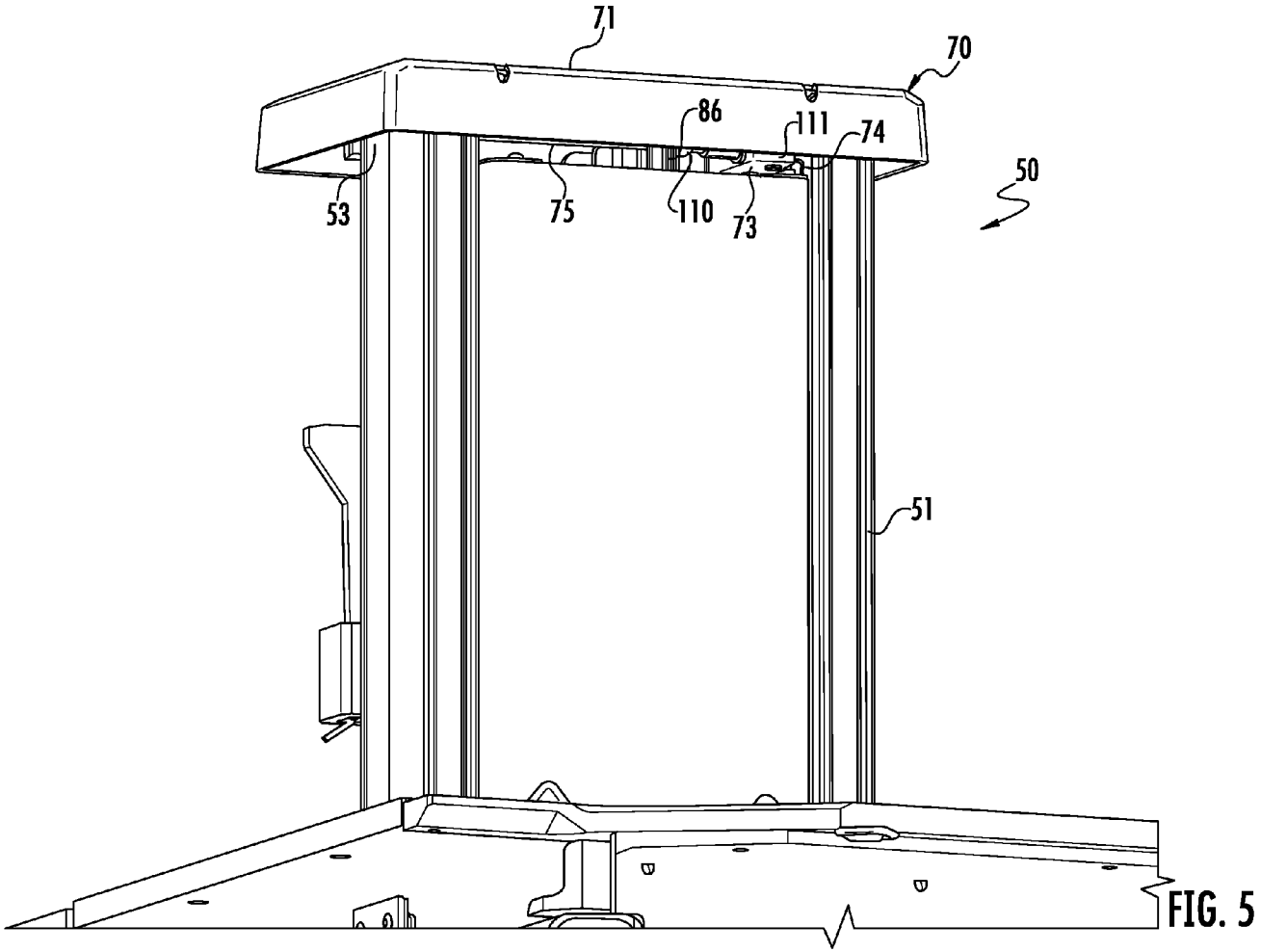
FIG. 5 is a view similar to that of FIG. 4 illustrating the collision control apparatus as it would appear in a safe configuration.
Figure 6:
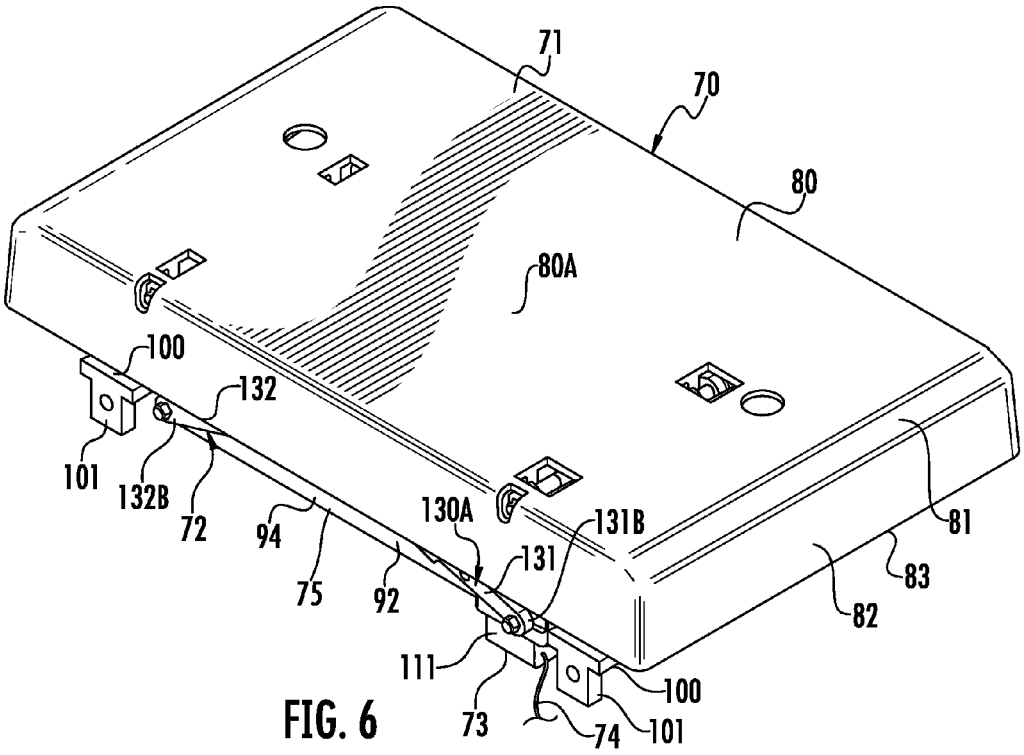
FIG. 6 is a top perspective view of the collision control apparatus of FIG. 1.
Figure 7:
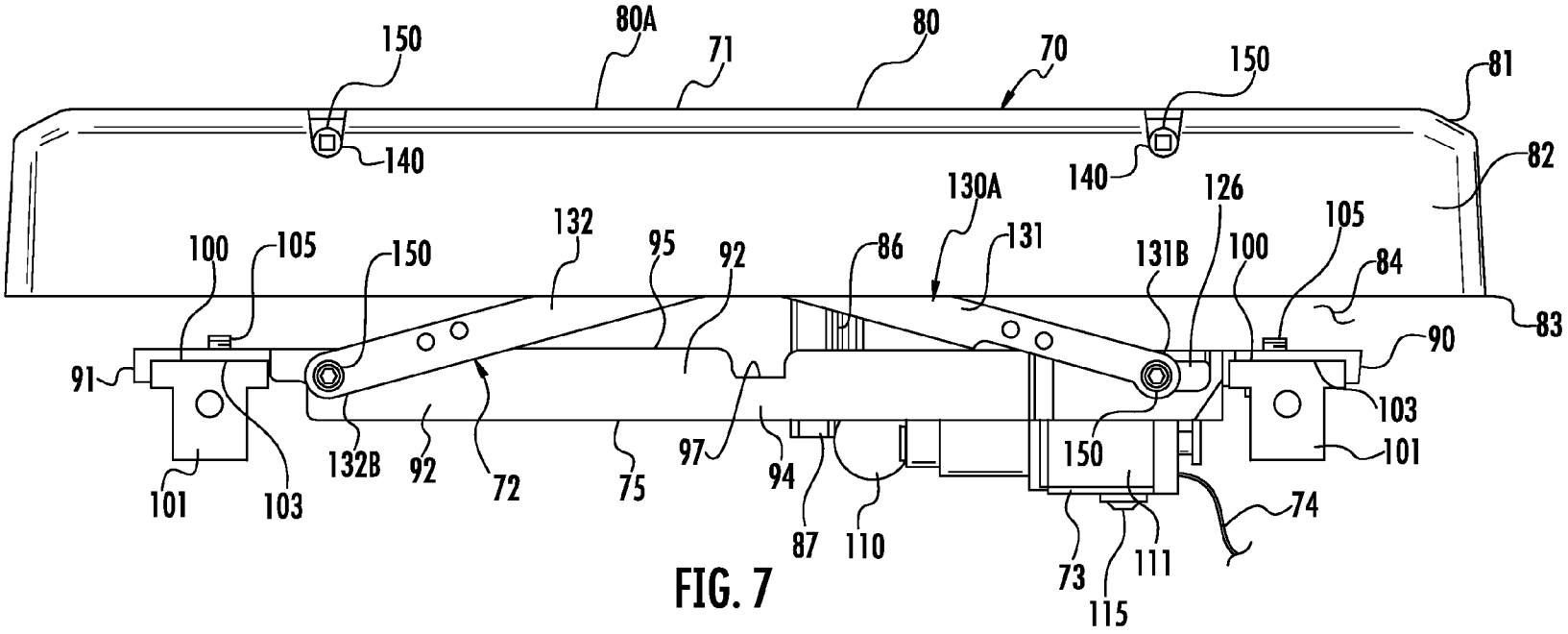
FIG. 7 is a side elevation view of the embodiment of FIG. 5.
Figure 8:
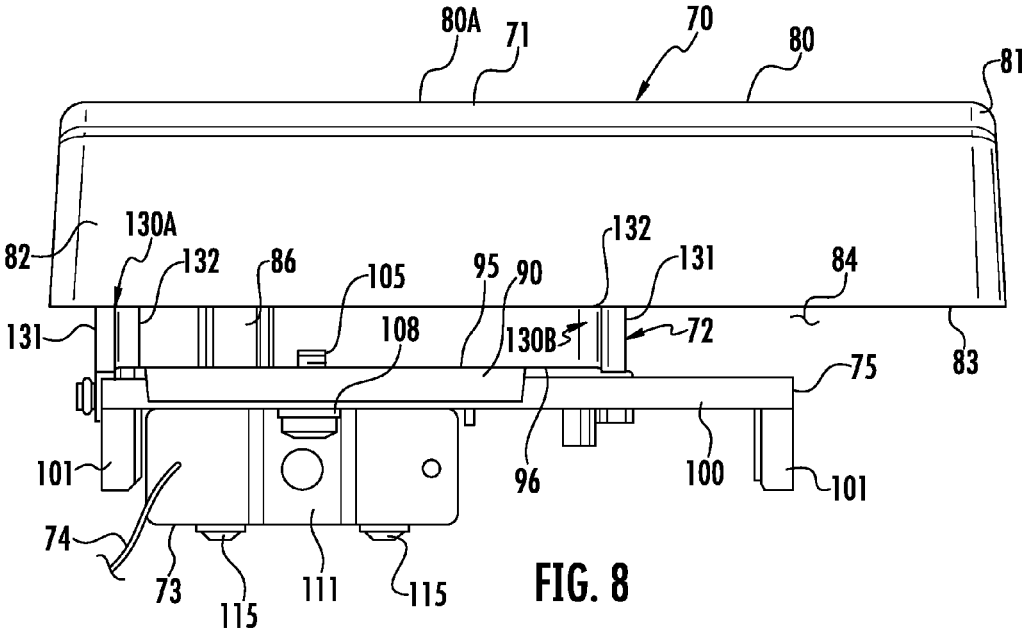
FIG. 8 is an end elevation view of the embodiment of FIG. 6.
Figure 9:
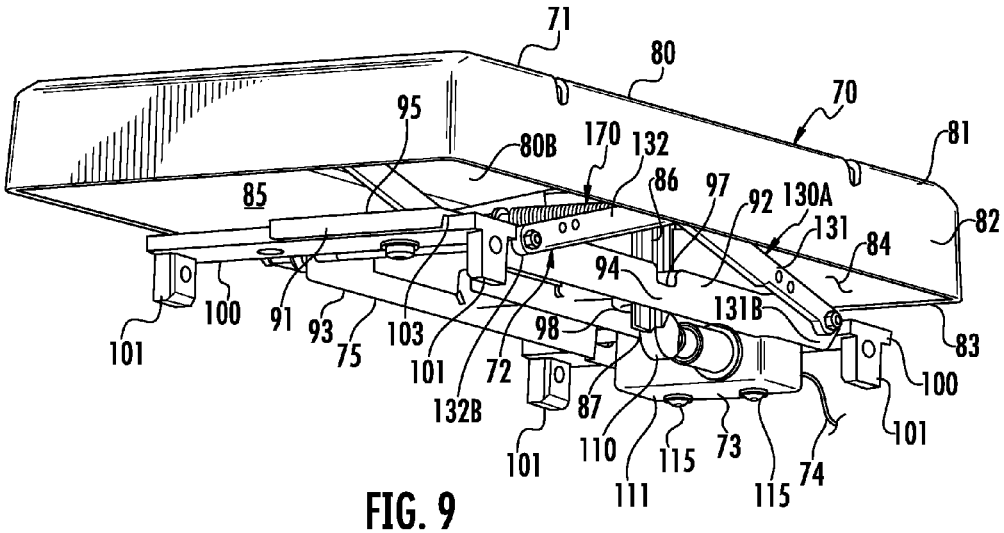
FIG. 9 is a bottom perspective view of the embodiment of FIG. 6.
Figure 10:
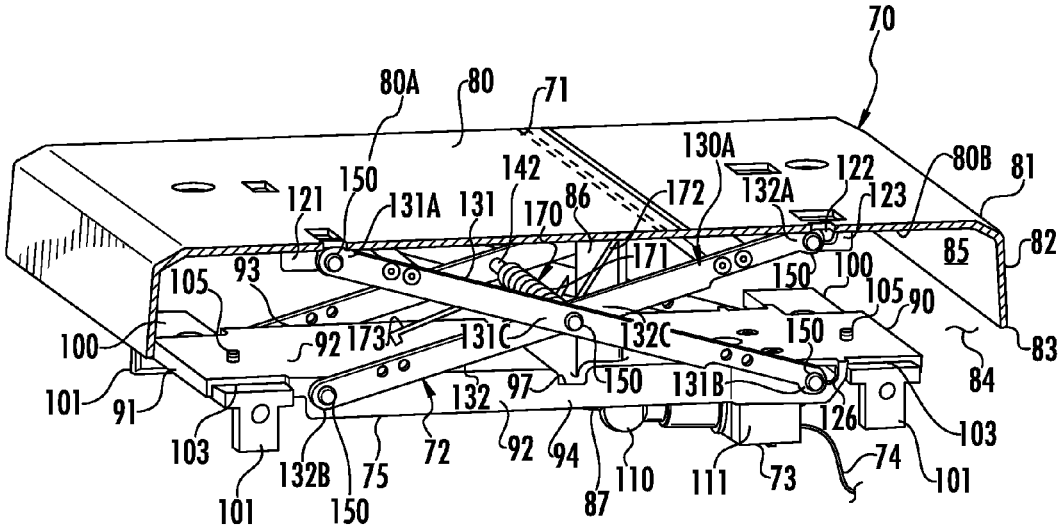
FIG. 10 is a top perspective view of the embodiment of FIG. 6 with portions thereof being broken away for illustrative purposes.
Figure 18:
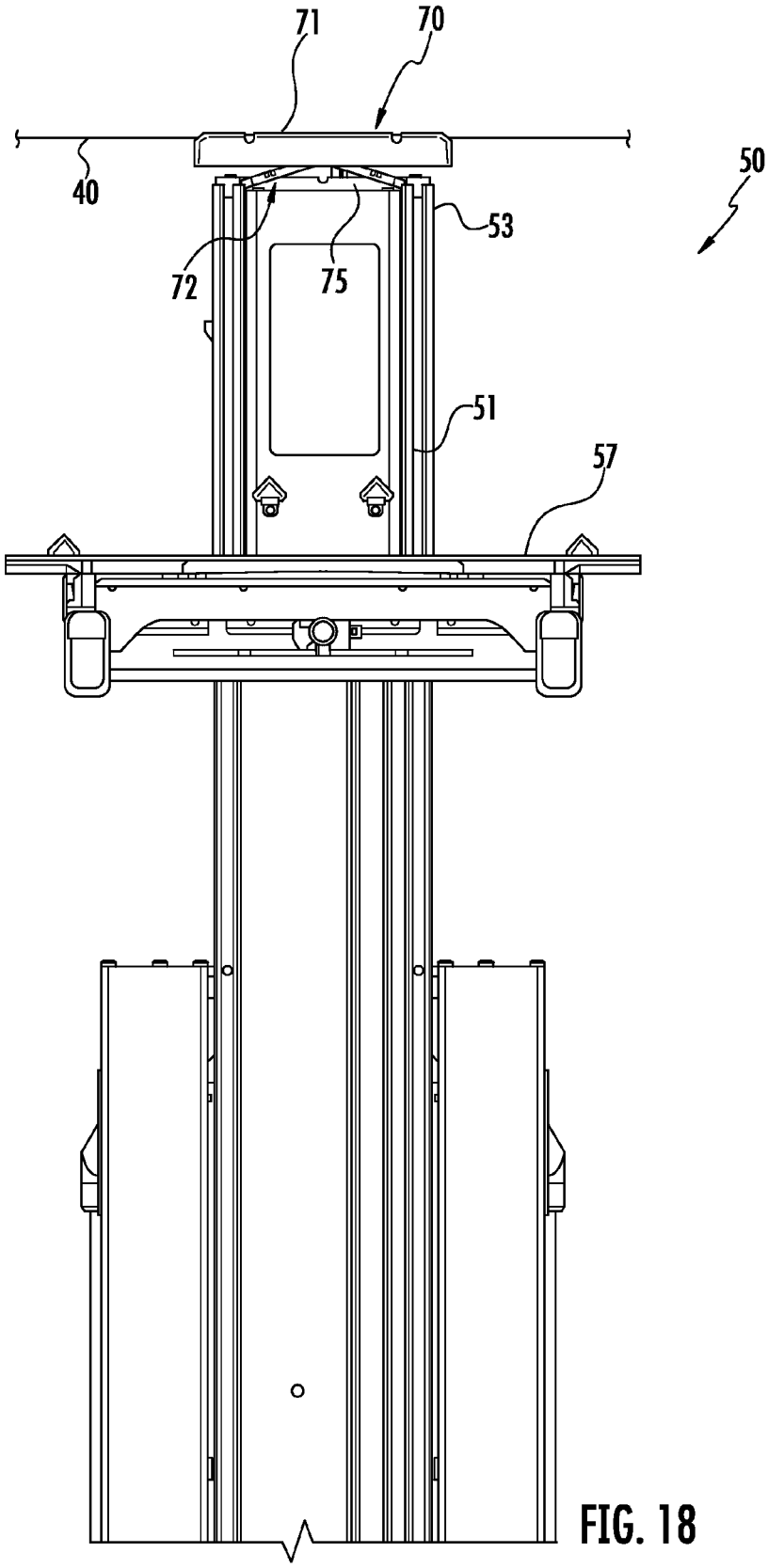
FIG. 18 is fragmented front elevation view of the embodiment of FIG. 17 illustrating the obstruction located above the collision control apparatus and the lifting mast.
Figure 20:
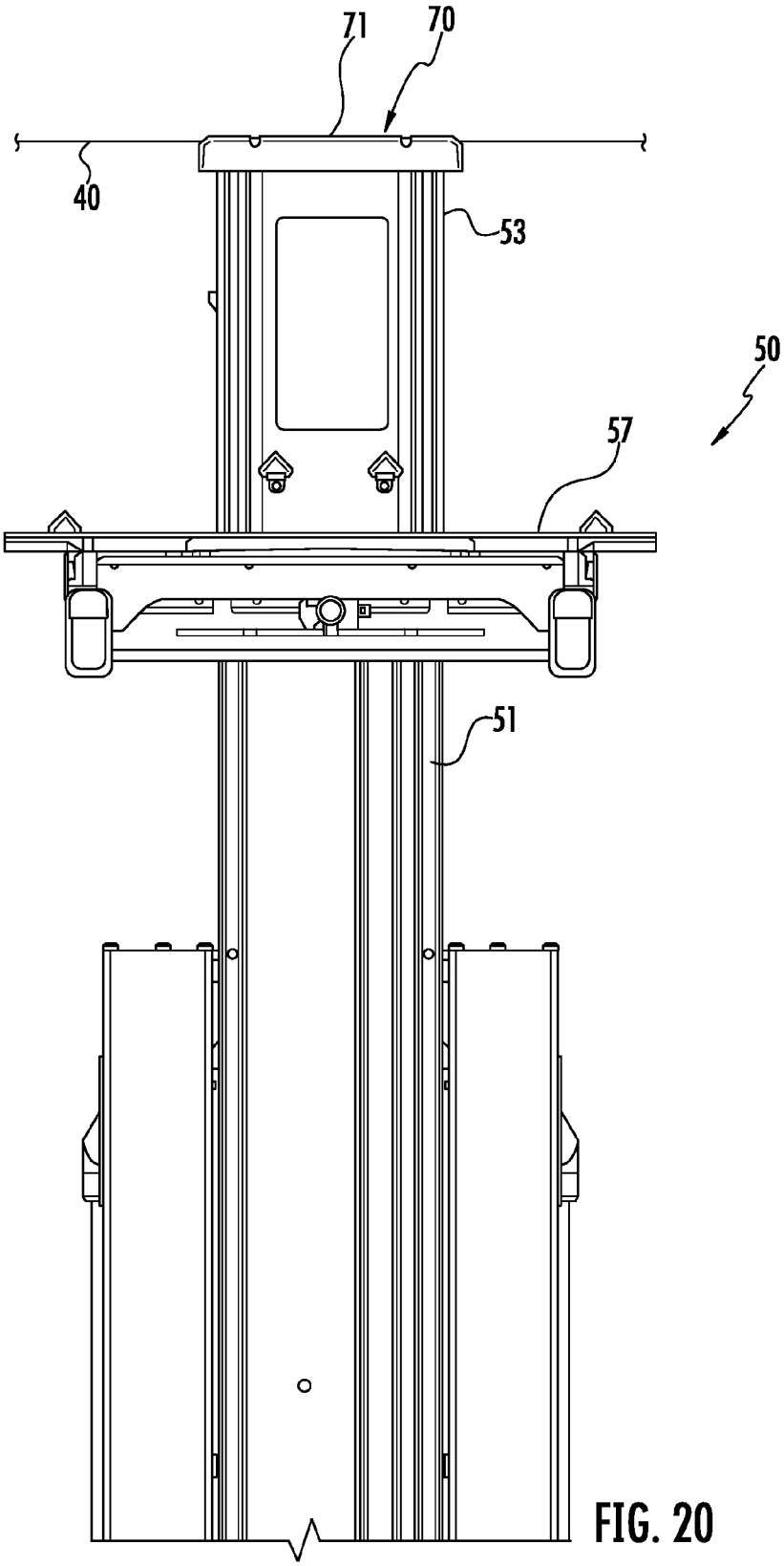
FIG. 20 is a fragmented front elevation view of the embodiment of FIG. 19 illustrating the obstruction contact encountering and deflecting the collision control apparatus.

According to the principle of the invention, lift device 50 is formed with an attached collision control apparatus denoted generally at 70 in FIGS. 1-5, which controls the operation of lifting mast 51 for ensuring the safe operation of lifting mast 51 against collision of lifting mast 51 with an overhead obstruction that lifting mast 51 could encounter response to movement of lifting mast 51 in the lifting direction toward an overhead obstruction. Collision control apparatus 70 is attached to top 53 of lifting mast 51, and adjusts between a neutral configuration as shown in FIGS. 4, 17, and 18, and a safe configuration as shown in FIGS. 5, 19, and 20 in response to collision control apparatus 70 contact encountering, i.e. contacting, an overhead obstruction denoted at 40 in FIGS. 19 and 20, which is an overhead obstructing surface in the present example formed, for example, by an overhead beam, duct, or the like. According to the principle of the invention, collision control apparatus 70 is operatively coupled to drive assembly 55 referenced in FIGS. 1-3 such that drive assembly 55 is enabled for moving of lifting mast 51 in the lifting direction indicated by arrowed line A in FIG. 1 to the lifting, lifted, or raised position of lifting mast 51 shown in FIGS. 17-20 and the lowering direction indicated by arrowed line B in FIG. 1 to the lowered position of lifting mast 51 shown in FIGS. 1-3 in the neutral configuration of collision control apparatus 70 as shown in FIGS. 1-4, 17, and 18, drive assembly 55 is enabled for moving lifting mast in the lowering direction indicated by arrowed line B in FIG. 1 to the lowered position of lifting mast 51 shown in FIGS. 1-3 in the safe configuration of collision control apparatus 70 as shown in FIG. 5, and drive assembly 55 is disabled for moving lifting mast 51 in the lifting direction indicated by arrowed line A in FIG. 1 in the safe configuration of collision control apparatus 70 as shown in FIGS. 5, 19, and 20. In the neutral configuration of collision control apparatus 70 illustrated in FIG. 4, drive assembly 55 is enabled to be operated from control panel 56 for moving lifting mast 51 in the lowering and lifting directions for lifting and lowering equipment or material or other load applied to support platform 57 in the normal operation of lift device 50. In the safe configuration of collision control apparatus 70 as shown in FIG. 5 in response to collision control apparatus 70 contact encountering an overhead obstruction, collision control apparatus 70 disables drive assembly 55 from moving lifting mast 51 in the lifting direction stopping movement of lifting mast 51 in the lifting direction and further disables drive assembly from being operated from control panel 56 for moving lifting mast 51 in the lifting direction thereby preventing an unwanted collision from occurring at top 53 of lifting mast 51 that could cause damage to lifting mast 51 or to the load carried by support platform 57 and furthermore preventing an operator from inadvertently operating the drive assembly 55 in the lifting direction that again could cause damage to lifting mast 51 and to a load carried by support platform 57, but in the safe configuration of collision control apparatus 70 drive assembly 55 is enabled for moving lifting mast 51 in the lowering direction and drive assembly 55 is further enabled to be operated from control panel for moving lifting mast 51 in the lowering direction thereby allowing an operator to move lifting mast 51 in the lowering direction and away from the overhead obstruction, in accordance with the principle of the invention. And so in the neutral configuration of collision control apparatus 70 drive assembly 55 is operable for moving lifting mast in the lifting and lowering directions in the normal operation of lift device 50, and in the safe configuration of collision control apparatus 70 drive assembly 55 is disabled for moving lifting mast 51 in the lifting direction to prevent a potentially catastrophic or dangerous collision in the movement of lifting mast 51 in the lifting direction, and is enabled for moving lifting mast 55 in the lowering direction to permit lifting mast 51 to be withdrawn from an overhead object or obstruction.

Looking to FIG. 4, collision control apparatus 70 is attached to top 53 of lifting mast 51. Collision control apparatus 70 includes a head 71 positioned above and over top 53 of lifting mast 51, and is mounted to lifting mast 51 for displacement/movement in reciprocal directions indicated by double arrowed line C between a raised neutral position shown in FIGS. 4, 17, and 18 away from top 53 of lifting mast 51 and a lowered safe position shown in FIGS. 5, 19, and 20 toward top 53 of lifting mast 51 in response to head 71 contact encountering an object/obstruction above top 53 of lifting mast 51 and head 71, such as obstruction 40 in FIGS. 19 and 20, in response to movement of lifting mast 51 in the lifting direction of lifting mast 51. Drive assembly 55, referenced in FIGS. 1-3, is enabled for moving of lifting mast 51 in the lifting and lowering directions of lifting mast 51 in the neutral position of head 71 shown in FIG. 4, drive assembly 55 is enabled for moving lifting mast 51 in the lowering direction of lifting mast 51 in the safe position of head 71 as shown in FIG. 5, and drive assembly 55 is disabled for moving lifting mast 51 in the lifting direction of lifting mast 51 in the safe position of head 71 shown in FIG. 5, and all of this characterizes an operative coupling between head 71 of collision control apparatus 70 and drive assembly 55.

In the neutral position of head 71, collision control apparatus 70 is in the neutral configuration. In the safe position of head 71, collision control apparatus 70 is in the safe configuration. A bias is applied to head 71 tending to bias head 71 from the safe position of head 71 defining the safe configuration of collision control apparatus 70 to the neutral position of head 71 defining the neutral configuration of collision control apparatus 70. This applied bias holds head 71 in its neutral position defining the neutral configuration of collision control apparatus 70 in the absence of an applied force to head 71 in the form of a collision between head 71 and an overhead obstruction. In response to a force applied to head 71 in the form of a contact collision of head 71 with an overhead obstruction in response to movement of lifting mast in the lifting direction, the bias applied to head 71 is available to be overcome causing head 71 to move from the neutral position of head 71 defining the neutral configuration of collision control apparatus 70 to the safe position of head 71 defining the safe configuration of collision control apparatus 70. The bias applied to head 71 acts on head 71 and urges head 71 from the safe position thereof to the neutral position thereof to reset head 71 from the safe position thereof to the neutral position thereof in the absence of an applied force to head 71 in the form of a collision between head 71 and an overhead obstruction.

Head 71 is mounted to lifting mast 51 for displacement between its neutral and safe positions with a linkage assembly 72 interacting between, or otherwise coupled between, head 71 and lifting mast 51. Linkage assembly 72 is coupled between head 71 and top 53 of lifting mast 51. Head 71 covers top 53 of lifting mast 51 so as to shield top 53 of lifting mast 51 from directly contacting or contact encountering an object or obstruction above top 53 of lifting mast 41 and head 71 causing head 71 to take the brunt of impact with such an object or obstruction above top 53 of lifting mast 51 and head 71.

Head 71 is operatively coupled to drive assembly 55, referenced in FIGS. 1-3, of lift device 50 with a switch 73, which, in turn, is operatively coupled to drive assembly 55. Switch 73, referenced in FIGS. 4 and 5, is operatively coupled to drive assembly 55, referenced in FIGS. 1-3, with conventional electrical wiring denoted generally at 74 in FIGS. 4 and 5. Switch 73 is coupled to interact between head 71 and top 53 of lifting mast 51 so as to be moved between deactivated and activated positions enabling drive assembly 55 for moving lifting mast 51 in the lifting and lowering directions of lifting mast 51 in the neutral position of head 71 shown in FIG. 4 corresponding to the deactivated position of switch 73, disabling drive assembly for moving lifting mast in the lifting direction of lifting mast 51 in the safe position of head 71 shown in FIG. 5 corresponding to the activated position of switch 73, and enabling drive assembly 55 for moving lifting mast 51 in the lowering direction of lifting mast 51 in the safe position of head 71 corresponding to the activated position of switch 73. Because switch 73 limits the operation of drive assembly 55 when switch 73 is activated, namely, disables drive assembly 55 from moving lifting mast 51 in the lifting direction while allowing drive assembly 55 to operate for moving lifting mast 51 in the lowering direction, switch 73 is considered a limit switch.

Collision control apparatus 70 incorporates a base 75 shown in FIG. 4, which is removably coupled to top 53 of lifting mast 51. Base 75 is used to removably couple collision control apparatus 70 to top 53 of lifting mast 51. Linkage assembly 72 is coupled between base 75 and head 71 and couples base 75 to head 71 and thus couples head 71 with respect to top 53 of lifting mast 51. Switch 73 is attached to and is carried by base 75. Base 75 is positioned between top 53 of lifting mast 51 and head 71, and head 71 is positioned above and over not only top 53 of lifting mast 51 but also base 75 of collision control apparatus 70 and linkage assembly 72. Head 71 is mounted to base 75 with linkage assembly 72 that interacts between head 71 and base 75 for facilitating the displacement or movement of head 71 between the raised neutral position of head 71 away from base 75 and top 53 of lifting mast 51 defining the neutral configuration of collision control apparatus 70 and the lowered safe position of head 71 toward base 75 and top 53 of lifting mast 51 defining the safe configuration of collision control apparatus 70 in response to head 71 contact encountering an object or obstruction above base 75, top 53 of lift device 50, and head 71. With switch 73 attached to base 75, switch 73 interacts between head 71 and base 75 enabling drive assembly 55 for moving lifting mast 51 in the lifting and lowering directions of lifting mast 51 in the neutral position of head 71 shown in FIG. 4, disabling drive assembly for moving lifting mast in the lifting direction of lifting mast 51 in the safe position of head 71 shown in FIG. 5, and enabling drive assembly 55 for moving lifting mast 51 in the lowering direction of lifting mast 51 in the safe position of head 71.

FIGS. 6-14 illustrate various views of collision control apparatus 70. Referencing FIGS. 6-14 in relevant part in conjunction with the ensuing discussion, collision control apparatus 70 consists of four main parts, namely, head 71, base 75, linkage assembly 72 interposed between head 71 and base 75 coupling head 71 to base 75, and switch 73 attached to base 75, all of which have been initially introduced above. Base 75 is configured to be removably coupled to top 53 of lifting mast 51 referenced in FIGS. 1-5, which joins collision control apparatus 70 to top 53 of mast 51 as to be readily separable from top 53 of mast 51, such as for repair and maintenance. Collision control apparatus 70 extends upwardly from top 53 of lifting mast 51 from base 75 removably coupled to top 53 of lifting mast 51 to linkage assembly 72 and then to head 71.

Head 71 is a broad, inverted, tray-like body fashioned of plastic, wood, metal, or other material or combination of materials having the properties of rigidity, resiliency, and resistance to impacts. Head 71 is preferably integrally formed, such as through molding or machining, and may, in the alternative, be fashioned of a plurality of parts attached with joinery, such as welding, adhesive, heat bonding, or the like. Head 71 is generally rectangular in overall shape and includes a flat part or plate 80 having opposed outer and inner faces 80A and 80B, a perimeter extremity 81 and a continuous sidewall 82 depending downwardly from perimeter extremity 81 and which terminates downwardly with a perimeter edge 83 defining an opening 84 leading upwardly into a volume 85 bound or otherwise defined by inner face 80A of flat part 80 and continuous sidewall 82. Head 71 is formed with an attached abutment 86, which is an elongate post that is rigidly affixed to inner face 80B of flat part 80 and which depends downwardly therefrom through volume 85 and opening 84 to an outer end 87. Abutment 86 is elongate and has a length extending from its attachment point to inner face 80B of flat part 80 of head 71 to outer end 87. Base 75 is located under and opposes opening 84 and volume 85 of head 71, linkage assembly 72 is coupled between head 71 and base 75, and abutment 86 is positioned to interact with switch 73 in response to movement of head 71 between its raised neutral position and its lowered safe position for deactivating and activating switch 73.

Figure 14:
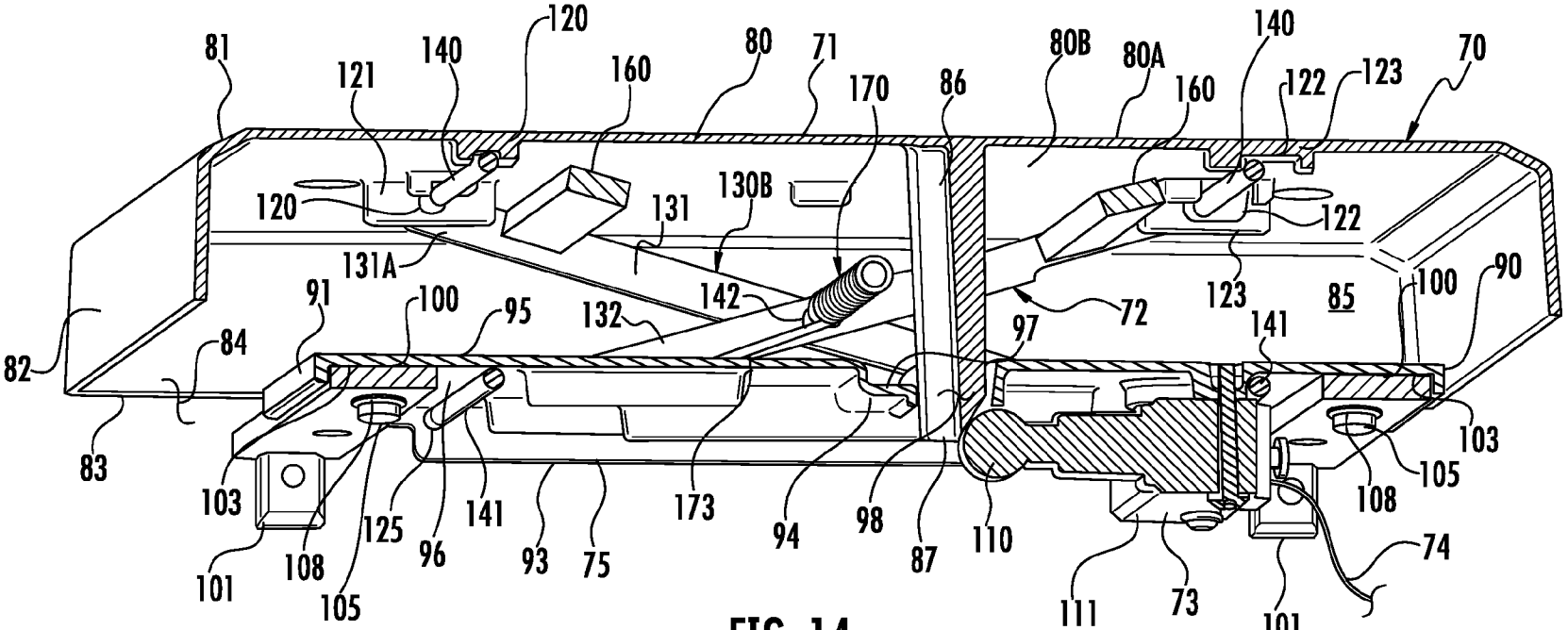
Figure 15:
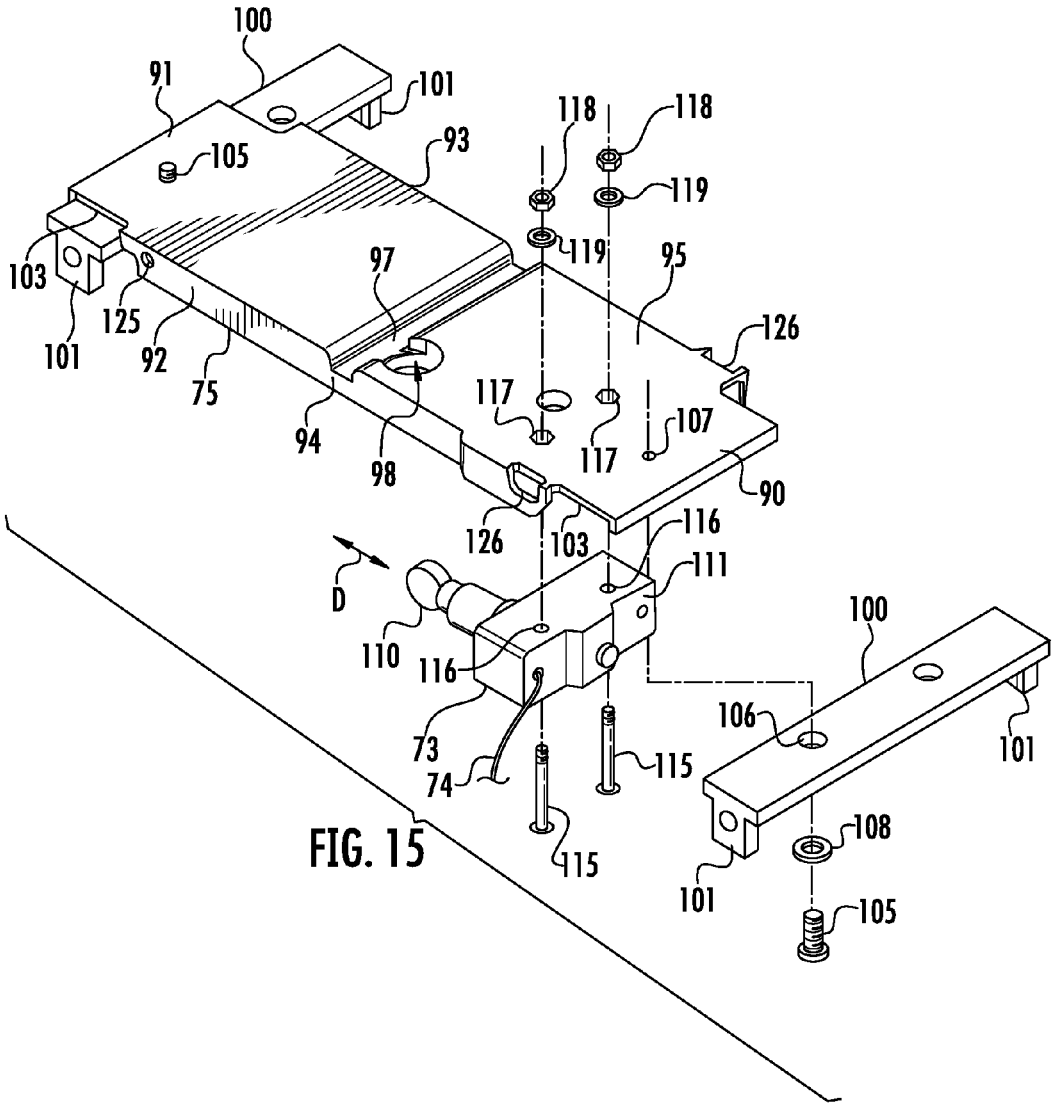
FIG. 15 is an exploded perspective view of a base assembly of the embodiment of FIG. 6.

Base 75 forms part of a base assembly of collision control apparatus 70, which principally includes base 75 and switch 73 attached to base 75. FIG. 15 is an exploded perspective view of the base assembly illustrating base 75 and switch 73. Referring to FIG. 15 and referring in relevant part to FIGS. 6-14, base 75 is a broad, tray-like body that is generally rectangular in shape and that in size is smaller than head 71 permitting base 75 to pass into volume 85 of head 71 through opening 84 of head 71 disclosed and discussed above in response to movement of head 71 between the neutral and safe positions thereof with respect to base 75. Base 75 is fashioned of plastic, wood, metal, or other material or combination of materials having the properties of rigidity, resiliency, and resistance to impacts. Base 75 is preferably integrally formed, such as through molding or machining, and may, in the alternative, be fashioned of a plurality of parts attached with joinery, such as welding, adhesive, heat bonding, or the like. Base 75 has opposed ends 90 and 91, opposed sides 92 and 93 extending between opposed ends 90 and 91, a middle between ends 90 and 91 denoted generally at 94, a top side 95, and an opposed bottom side or underside 96 referenced in FIG. 14. A transverse channel 97 is formed at middle 94 in top side 95 of base 75, which is parallel with respect to ends 90 and 91 and which extends from side 92 of base 75 to side 93 of base 75. An abutment-receiving opening 98 that receives therethrough and accommodates abutment 86 of head 71 is formed through base 75 near side 92 between sides 92 and 93, and is positioned between channel 97 and end 90.

Ends 90 and 91 of base 75 are each fashioned with an attached strap 100 used to removably couple base 75 to top 53 of lifting mast 51. Straps 100 each have opposed lugs 101 depending downwardly from either end of strap 100 on either of sides 92 and 93 of base 75, which receive fasteners, such as set screws, used to removably couple base 75, and thus collision control apparatus 70, to top 53 of lifting mast 51 of lift device 50 discussed in conjunction with FIGS. 1-3. Straps 100 are parallel with respect to each other and are transverse with respect to the long axis of base 75 extending from end 90 to end 91. Like base 75, straps 100 and 101 are each fashioned of plastic, wood, metal, or other material or combination of materials having the properties of rigidity, resiliency, and resistance to impacts. Straps 100 are received along the underside 96 of base 75 at the corresponding ends 90 and 91 of base 75, are received in corresponding seats 103 form near ends 90 and 91 in underside 96 of base 75, and are each removably coupled to base 75 with a threaded fastener 105 that extends through an opening 106 in strap 101 between lugs 101 and which is threaded into a threaded opening in base 75. A washer 108 is applied onto threaded fastener 105 between each strap 100 and the head of the corresponding threaded fastener 105 to give tightness to the joint when the threaded fastener 105 is tightened. With straps 100 so attached to base 75 along the underside 96 of base 75, the corresponding lugs 101 depending downwardly with respect to straps 100 and underside 86 of base 75. To removably secure base 75 to top 53 of lifting mast 51 as shown in FIG. 4, base 75 is placed underside 96 (not shown in FIG. 4) down onto top 53 of lifting mast 51 positioning the underside of straps 100 onto either side of top 53 of lifting mast 51 and locating lugs 101 along the front and rear sides of lifting mast 51 and that are identically secured to lifting mast with set screws 60 that are received through openings in lugs 60 and which are tightened down against mast 51 securing base 75 in place.

Figure 21:
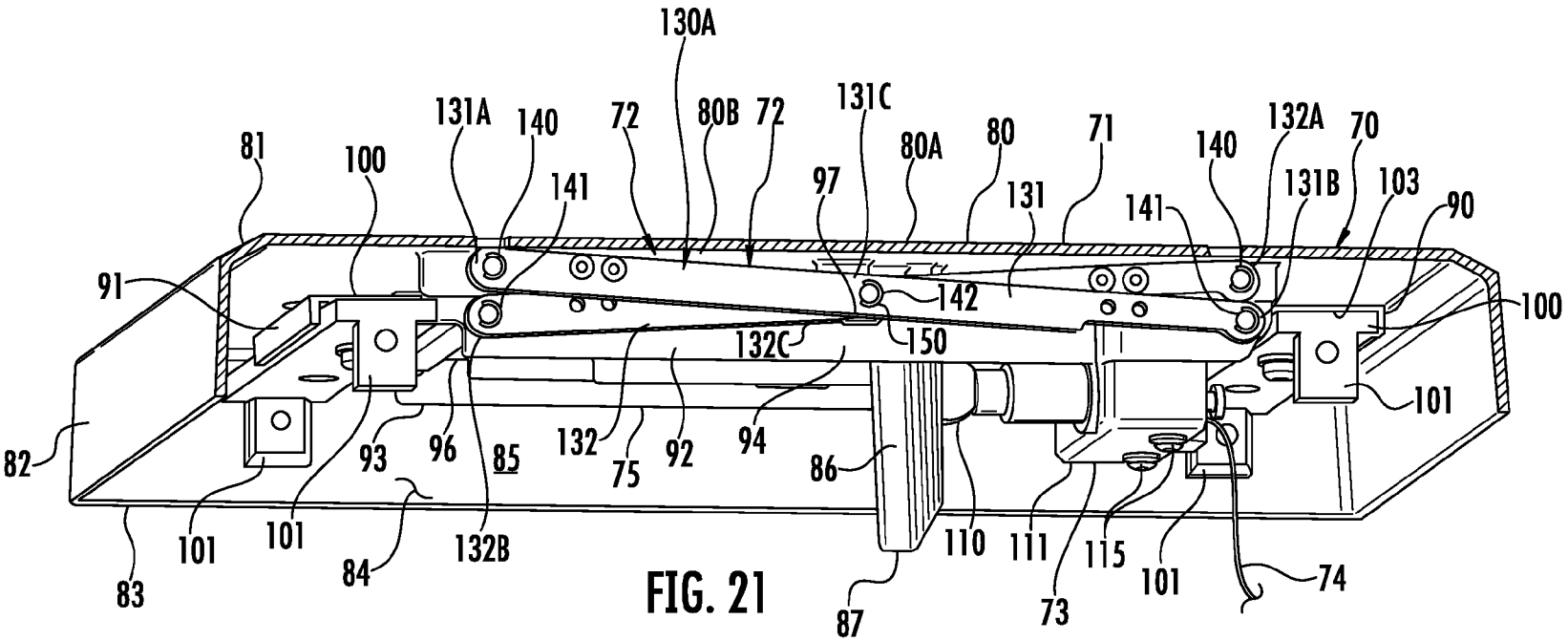
FIGS. 21 and 22 bottom perspective views of the embodiment of the collision control apparatus of FIG. 18 shown as it would appear deflected, with portions thereof being broken away for illustrative purposes.

Switch 73 is an entirely conventional and well-known switch, which includes a spring-loaded plunger 110 and a switch body 111 containing a conventional and well-known toggle switch, which is activated and deactivated in response to movement of plunger 110 in reciprocal directions as indicated by double arrowed line D between an extended position as shown in FIG. 15 deactivating switch 73 and a depressed position as shown in FIG. 21 activating switch. Switch 73 referenced in FIGS. 4 and 5 is operatively coupled to the lifting circuit of drive assembly 55, referenced in FIGS. 1-3, with conventional electrical wiring denoted generally at 74 in FIGS. 4 and 5. In the extended position of plunger 110 deactivating switch 73, the lowering and lifting circuits of drive assembly 55 are enabled thereby enabling drive assembly 55 for moving lifting mast 51 in the lifting and lowering directions of lifting mast 51 thereby enabling drive assembly 55 to be operated from control panel 56 for moving lifting mast 51 in the lifting and lowering directions. In the depressed position of plunger 110 activating switch 73, the lifting circuit of drive assembly 5 is disabled by switch 73 disabling drive assembly 55 for moving lifting mast in the lifting direction of lifting mast 51 thereby disabling drive assembly 55 from being operated from control panel 56 for moving lifting mast 51 in the lifting direction, and the lowering circuit of drive assembly 55 remains unaffected and is thereby enabled for moving lifting mast 51 in the lowering direction of lifting mast 51 thereby enabling drive assembly 55 to be operated from control panel 56 for moving lifting mast 51 in the lowering direction. The coupling between switch 73 and the lifting circuit of drive assembly 55 via wiring 74 is formed through conventional wiring techniques well within the skill and knowledge of a skilled electrician.

Switch 73 is received along the underside 96 of base 75 between sides 92 and 93 of base 75 and between opening 98 and end 90 of base 75 including strap 100 removably coupled to end 90 of base 75, and is located between top 53 of mast 51 and underside 96 of base 75 removably coupled to upper end 53 of lifting mast 51 as shown in FIG. 4. Switch body 111 is received against underside 96 of base 75 and is removably coupled to base 75 with threaded fasteners 115 that extends through corresponding openings 116 in switch body 111 and corresponding openings 117 in base 75, and which are threaded into corresponding nuts 118, which are received captured in openings 117 from top side 95 of base 75 and which are tightened to secure switch 73 in place along underside 96 of base 75. Washers 119 are applied onto threaded fasteners 115 in openings 117 between nuts 118 received in openings 118 and base 75 to give tightness to the joints when nuts 118 are tightened onto threaded fasteners 115. Plunger 110 extends away from switch body 111 toward middle 94 of base 75, and is located under opening 98 as shown in FIG. 14 and is registered with respect to opening 98. Head 71 is mounted to the described base assembly of collision control apparatus 70 for movement between its neutral and safe positions with linkage assembly 72, and the base assembly is, in turn, removably coupled to top 53 of lifting mast 51 as shown in FIG. 4.

Linkage assembly 72 is interposed between head 71 and base 75 as best seen in FIGS. 10-14, couples head 71 to base 75, and articulates between extended and collapsed positions, orientations, or states to permit head 71 to move between its raised neutral position away from base 75 and its lowered safe position toward base 75. In the raised neutral position of head 71, linkage assembly 72 is extended or is otherwise in an extended orientation or state. In the lowered safe position of head 71, linkage assembly 72 is collapsed or is otherwise in a collapsed orientation or state. In response to movement of head 71 from its raised neutral position away from base 75 to is lowered safe position toward base 75, linkage assembly 72 articulates from its extended position, orientation, or state to its collapsed position, orientation, or state and collapses into volume 85 of head 71 through opening 84 and base 75 passes through opening 84 into volume 85. In response to movement of head 71 from its lowered safe position to its raised neutral position, linkage assembly 72 articulates from its collapsed position, orientation, or state to its extended position, orientation, or state and linkage assembly 72 and base 75 extend outwardly from volume 85 through opening 84 to base 75.

In the attachment of head 71 to base 75 with linkage assembly 72, abutment 86 registers with opening 98 formed through base 75 and extends downwardly from inner face 80B of head 71 through volume 85 and opening 84 of head 71 and through opening 98 of base 75 as seen in FIG. 14 to outer end 87, which is located under the underside 96 of base 75 and which opposes and confronts abutment 110 of switch 73. Abutment 86 of head 71 passes through opening 98 of base 75 and reciprocates through opening 98 of base 75 in response to movement of head 71 between its raised neutral position and its lowered safe position. In the raised neutral position of head 71 as shown in FIGS. 4, 7, and 9-14, outer end 87 of abutment 86 confronts abutment 110 of switch 73 and abutment 110 is in its extended position deactivating switch 73.

Figure 22:
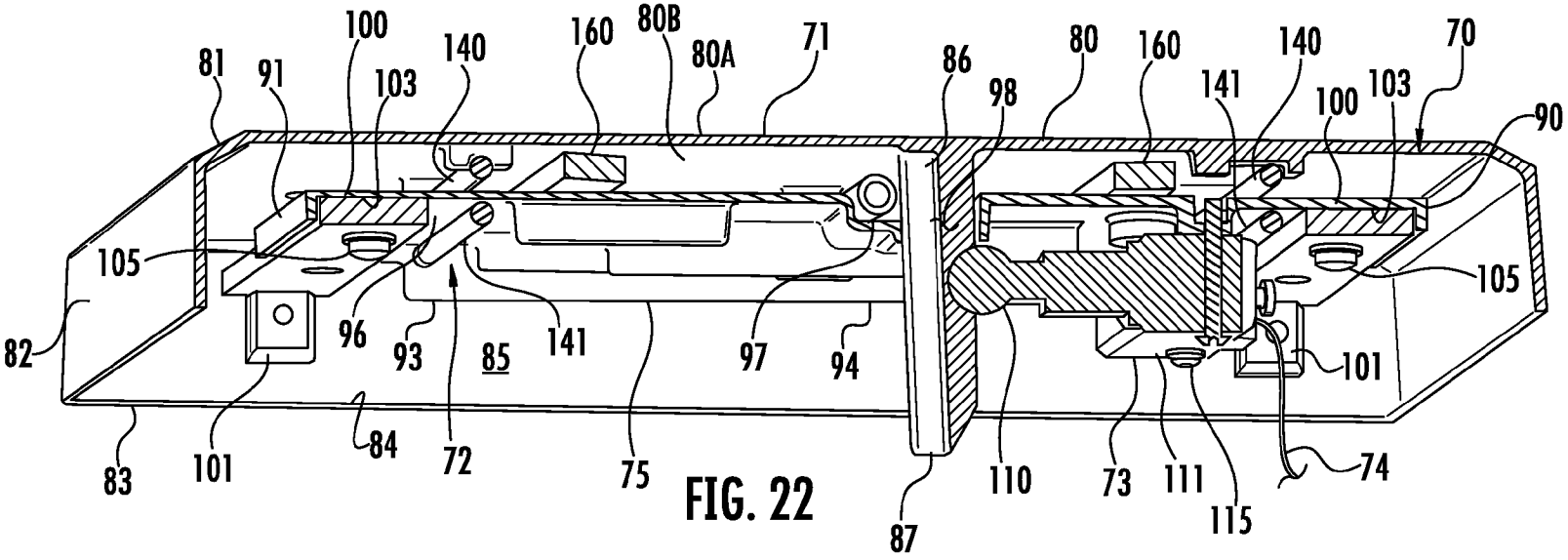

In response to movement of head 71 from its raised neutral position as shown in FIGS. 4, 7, 9-14, to is lowered safe position as shown in FIGS. 5, 21, and 22, abutment 86 is driven downwardly toward base 75 and switch 73, and outer end 87 of abutment 86 encounters and is driven against plunger 100 depressing plunger 110 from its extended position to its depressed position as shown in FIGS. 21 and 22 activating switch 73. Switch 73 is activated with minimal displacement of head 71 from its raised or neutral position into and toward its lowered safe position causing outer end 87 of abutment 86 to encounter and depress plunger 100, and abutment 86 interacts with plunger 110 along the length of abutment 86 from its attachment point to inner face 80B of flat part 80 of head 71 to outer end 87 and keeps plunger 110 depressed activating switch 73 along the path of displacement of head 71 from its raised neutral position to its lowered safe position, according to the principle of the invention.

The length of abutment from its attachment point to inner face 80B of flat part 80 of head 71 to outer end 87 provides for over-travel of head 71 from its raised neutral position to its lowered safe position while maintaining the depression of plunger 110 by abutment 86 along the length of abutment 86 from its attachment point to inner face 80B of flat part 80 of head 71 to the outer end 87 of abutment, and this over-travel of head 71 from its raised neutral position to its lowered safe position provides play in the form of an over-travel distance or buffer zone between the raised neutral position of head 71 and the lowered safe position of head 71 to prevent damage to head 71 and to collision control apparatus 70 as a whole and also to lifting mast 51 and to the overhead obstruction encountered by head 71. Plunger 110 is depressed activating switch 73 in response to an initial interaction of outer end 87 of abutment 86 against plunger 100 caused in response to displacement of head 71 from its raised neutral position into or otherwise toward its lowered safe position, and abutment 86 interacts with plunger 110 along the over-travel distance or buffer zone defined by the length of abutment 86 to ensure plunger 110 remains depressed and switch 73 remains activated along the over-travel distance or buffer zone. In the present embodiment as a matter of example, length of abutment 86 from its attachment point to inner face 80B of flat part 80 of head 71 to outer end 87 is approximately three inches, which defines an over-travel distance or buffer zone of head 71 between its raised neutral position and its lowered safe position of this distance of approximately three inches. Depending on specific needs or applications, the length of abutment 86 can be less than approximately three inches or greater than approximately three inches to define other over-travel distance or buffer zones of head 71 as may be desired.

In response to movement of head 71 from its lowered safe position as shown in FIGS. 21 and 22 to its raised safe position as shown in FIGS. 4, 7, 9-14, abutment 86 is driven upwardly away from base 75 and switch 73, and is driven upwardly away from plunger 110 moving abutment 86 out of its interaction with plunger 110 thereby un-depressing plunger 110 and permitting plunger 110 to move from its depressed position to its extended position deactivating switch 73. The interaction between abutment 86 of head 71 and plunger 110 of switch 73 forms an operative coupling between head 71 and switch 73 causing switch 73 to switch between its deactivated and activated positions in response to movement of head 71 between its raised neutral position and its lowered safe position, and switch 73 interacting between base 75 and head 71 forms an operative coupling of head 71 of collision control apparatus 70 to drive assembly 55.

Figure 16:
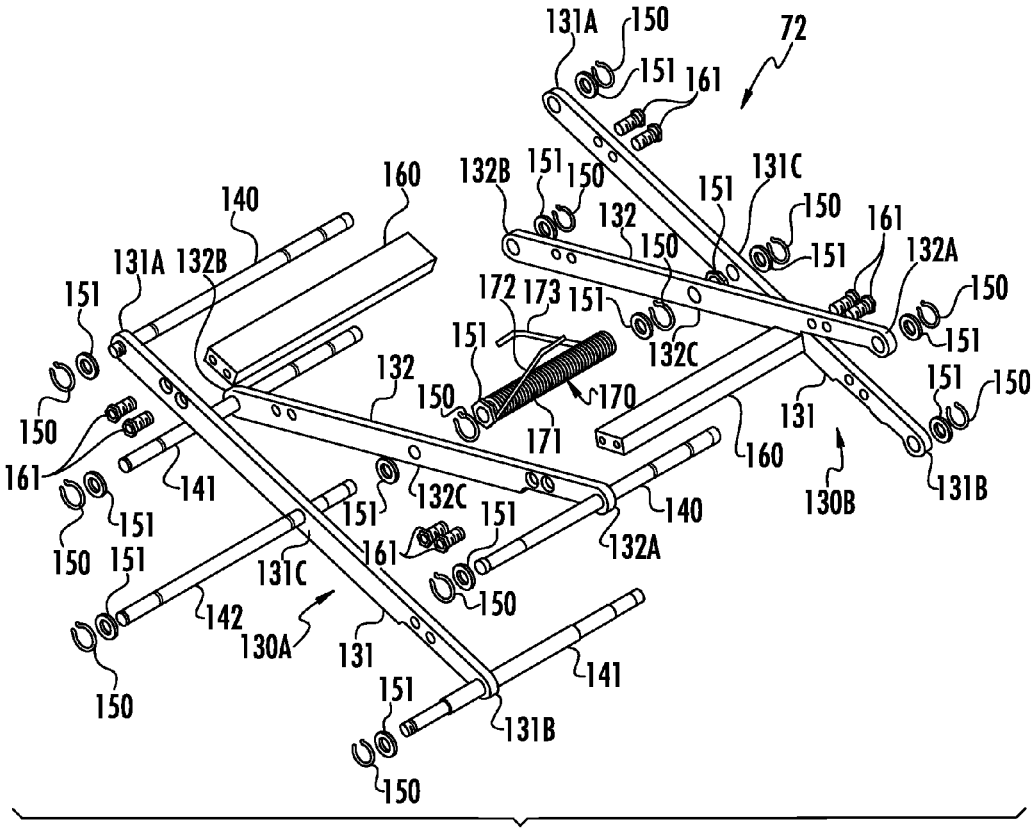
FIG. 16 is an exploded perspective view of a linkage assembly of the embodiment of FIG. 6.

Referring to FIGS. 10-14 in relevant part, and to FIG. 16 illustrating an exploded perspective view of linkage assembly 72, linkage assembly 72 is a scissor linkage that articulates between extended and collapsed positions, orientations, or states, and consists of opposed, identical folding scissor mechanisms 130A and 130B linked together with elongate connecting rods including upper connecting rods 140, lower connecting rods 141, and a central connecting rod 142. Upper connecting rods 140 of linkage assembly 72 are pivoted, i.e. pivotally attached, to head 71, and lower connecting rods 141 of linkage assembly 72 are pivoted, i.e. pivotally attached, to base 75.

Scissor mechanisms 130A and 130B are the mirror image opposites of one another and each include a pair of identical elongate members 131 and 132 arranged in a cross-cross pattern. Elongate members 131 each have opposed upper and lower ends 131A and 131B, and a middle 131C, and elongate members 132 each have opposed upper and lower ends 132A and 132B, and a middle 132C. One upper connecting rod 140 connects upper ends 131A of elongate members 131 and is pivoted to head 71, the other upper connecting rod 140 connects upper ends 132A of elongate members 132 and is pivoted to head 71, one lower connecting rod 141 connects lower ends 131B of elongate members 131 and is pivoted to base 75, and the other lower connecting rod 141 connects lower ends 132B of elongate members 132 and is pivoted to base 75. Elongate members 131 and 132 of each scissor mechanism 130A and 130B cross-cross at their respective middles 131C and 132C, and central connecting rod 142 pivotally connects the middles 131C and 132C the corresponding scissor mechanisms 130A and 130B and connects the middles 131C and 132C of one scissor mechanism 130A to the middles 131C and 132C of the opposed scissor mechanism 130B to about which scissor assemblies 130A and 13B are permitted to pivot between extended and collapsed conditions of linkage assembly 72 in response to the corresponding movement or displacement of head 71 between its neutral and safe positions.

Figure 13:
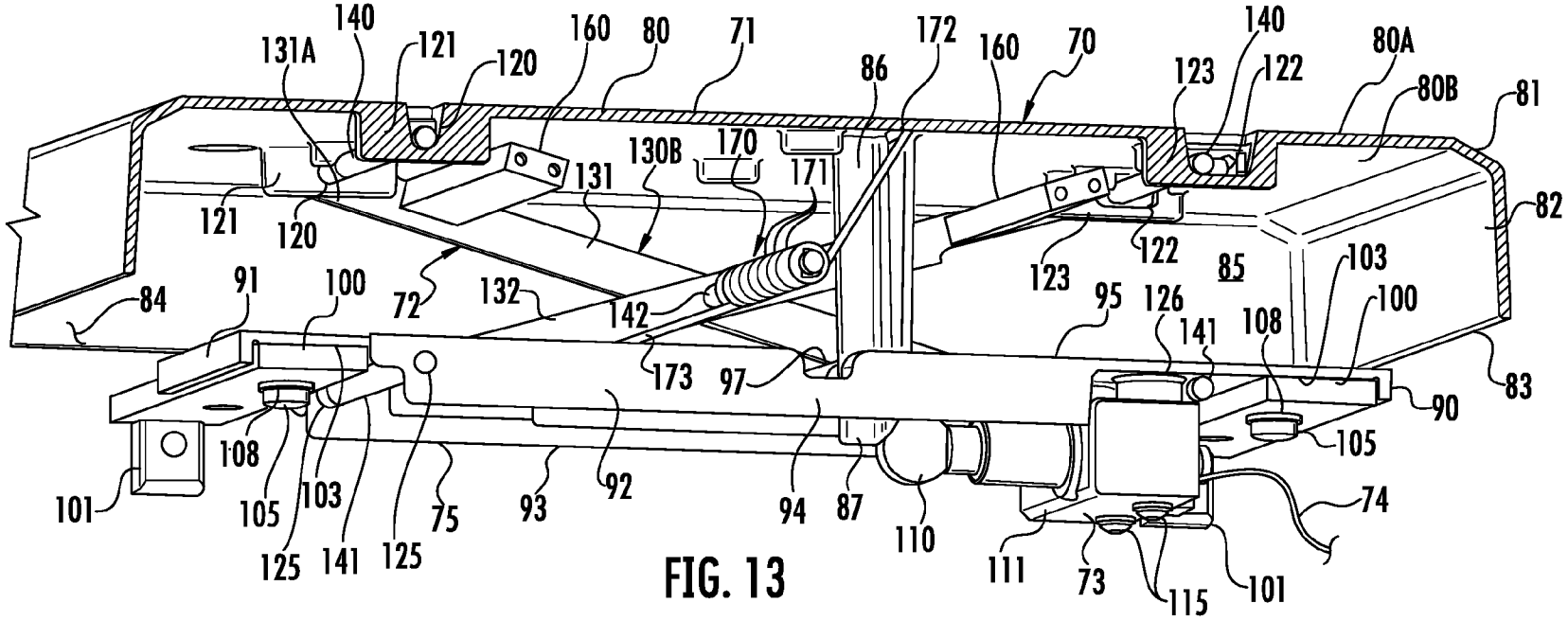
FIGS. 13 and 14 bottom perspective views of the embodiment of FIG. 6 with portions thereof being broken away for illustrative purposes.

Upper connecting rods 140 extend along inner face 80B of flat part 80 of head 71, and opposed lower connecting rods 141 extend along underside 96 of base 75. The opposed ends of upper connecting rod 140 connecting upper ends 131A of elongate members 131 extend through corresponding identical openings 120 formed in opposed tabs 121 attached to and depending downwardly from inner face 80B of flat part 80 of head 71 as best shown in FIG. 13, and then into openings in the corresponding upper ends 131A of elongate members 131, and are retained by corresponding clips 150 and washers 151 applied to the respective ends of upper connecting rod 140 on the outer sides of the respective tabs 121 connecting upper ends 131A of elongate members 131 together and to head 71. The opposed ends of upper connecting rod 140 connecting upper ends 132A of elongate members 132 extend through corresponding identical openings 122, which are elongated, formed in opposed tabs 123 attached to and depending downwardly from inner face 80B of flat part 80 of head 71 as best shown in FIG. 13, and then into openings in the corresponding upper ends 132A of elongate members 132, and are retained by corresponding clips 150 and washers 151 applied to the respective ends of upper connecting rod 140 on the outer sides of the respective tabs 123 connecting upper ends 132A of elongate members 132 together and to head 71.

The opposed ends of lower connecting rod 141 connecting lower ends 131B of elongate members 131 extend through corresponding identical openings 125 formed in sides 92 and 93 of base 75 near end 91 of base 75 between strap 100 attached to end 91 of base 75 and middle 94 of base 75 as best shown in FIG. 13, and then through openings in the corresponding lower ends 131B of elongate members 131, and are retained by corresponding clips 150 and washers 151 applied to the respective ends of lower connecting rod 141 along the outer sides of the respective sides 92 and 93 of base 75 connecting lower ends 131B of elongate members 131 together and to base 75. The opposed ends of lower connecting rod 141 connecting lower ends 132B of elongate members 132 extend through corresponding identical openings 126, which are elongated, formed in sides 92 and 93 of base 75 near end 90 of base 75 between strap 100 attached to end 90 of base 75 and middle 94 of base 75, and then through openings in the corresponding lower ends 132B of elongate members 132, and are retained by corresponding clips 150 and washers 151 applied to the respective ends of lower connecting rod 141 along the outer sides of the respective sides 92 and 93 of base 75 connecting lower ends 132B of elongate members 132 together and to base 75.

The opposed ends of upper connecting rod 140 connecting upper ends 131A of elongate members 131 are free to pivot in openings 120 of head 71, the opposed ends of upper connecting rod 140 connecting upper ends 132A of elongate members 132 are free to pivot in openings 122 of head 71, the opposed ends of lower connecting rod 141 connecting lower ends 131B of elongate members 131 are free to pivot in openings 125 of base 75, and the opposed ends of lower connecting rod 141 connecting lower ends 132B of elongate members 132 are free to pivot in openings 126 of base 75. Accordingly, the opposed ends of upper connecting rod 140 connecting upper ends 131A of elongate members 131 are pivotally attached to head 71, the opposed ends of upper connecting rod 140 connecting upper ends 132A of elongate members 132 are pivotally attached to head 71, the opposed ends of lower connecting rod 141 connecting lower ends 131B of elongate members 131 are pivotally attached to base 75, and the opposed ends of lower connecting rod 141 connecting lower ends 132B of elongate members 132 are pivotally attached to base 75.

One end of central connecting rod 142 extends through aligned corresponding openings in middles 131C and 132C of elongate members 131 and 132 of scissor mechanisms 130A and is retained by clip 150 and washer 151, and the other end of central connecting rod 142 extends through aligned corresponding openings in middles 131C and 132C of elongate members 131 and 132 of the opposed scissor mechanisms 130B and is retained by clip 150 and washer 151. A washer 151 is applied onto central connecting rod 142 between middles 131C and 132C of scissor mechanism 130A, and a washer 151 is applied onto central connecting rod 142 between middles 131C and 132C of elongate members 131 and 132 of scissor mechanism 130B. A stay 160 is secured to and between elongate members 131 of scissor mechanisms 130A and 130B between upper ends 131A of elongate members 131 and middles 131C and 131C of elongate members 131, and an identical stay 160 is secured to and between elongate members 132 of scissor mechanisms 130A and 130B between upper ends 132A of elongate members 132 and middles 132C and 132C of elongate members 132. The opposed ends of stay 160 coupled between elongate members 131 of scissor mechanisms 130A and 130B are affixed to elongate members 131 of scissor mechanisms 130A and 130B with threaded fasteners 161, and the opposed ends of stay 160 coupled between elongate members 132 of scissor mechanisms 130A and 130B are affixed to elongate members 132 of scissor mechanisms 130A and 130B with threaded fasteners 161. Stays 160 impart structural rigidity to linkage assembly 72.

Linkage assembly 72 is exemplary of a conventional scissor linkage assembly, whereby the identical folding scissor mechanisms 130A and 130B are linked together with elongate upper connecting rods 140 pivotally attached to head 71, lower connecting rods 141 pivotally attached to base 75, and central connecting rod 142 pivotally attaching middles 131C and 132C of elongate members 131 and 132 of scissor mechanism 130A to middles 131C and 132C of elongate members 131 and 132 of scissor mechanism 130B. Linkage assembly 72 is somewhat shortened in the extended position thereof corresponding to the neutral position of head 71, and is somewhat lengthened in the collapsed position thereof corresponding to the safe position of head 71. The elongation of openings 122 of head 71 and openings 126 of base 75 accommodate the lengthening and shortening of linkage assembly 72 in response to movement of linkage assembly 72 between its extended and collapsed positions, and ensures that linkage assembly 72 is free to move without restriction between its extended and collapsed positions in response to movement of head 71 between its neutral and safe positions.

According to the principle of the invention, linkage assembly 72 is fashioned with a tension spring 170. Tension spring 170 consists of a wire formed into coils 171 encircling central connecting rod 142 between, one the one hand, middles 131C and 132C of scissor mechanism 130A, and, on the other hand, middles 131C and 132C of scissor mechanism 130B. The opposed outermost coils of coils 171 of tension spring 170 lead to tag ends 172 and 173, respectively. Tag end 172 is directed upwardly toward upper ends 132A of elongate members 132 of scissor mechanisms 130A and 130B, and tag end 173 is directed oppositely and downwardly toward lower ends 132B of elongate members 132 of scissor mechanisms 130A and 130B. To retain tension spring 170 in place to central connecting rod 142, a clip 150 and a washer 151 are applied over central connecting rod 142 between the outermost coil of tension spring 170 formed with tag end 172 and middle 132C of elongate member 132 of scissor mechanism 130A, and a corresponding clip 150 and a washer 151 are applied over central connecting rod 142 between the outermost coil of tension spring 170 formed with tag end 173 and middle 132C of elongate member 132 of scissor mechanism 130B. Tension spring 170 is fashioned of spring steel, a nickel-based spring alloy, or other material or combination of materials having a substantially constant moduli of elasticity as is typical with tension springs.

Figure 11:
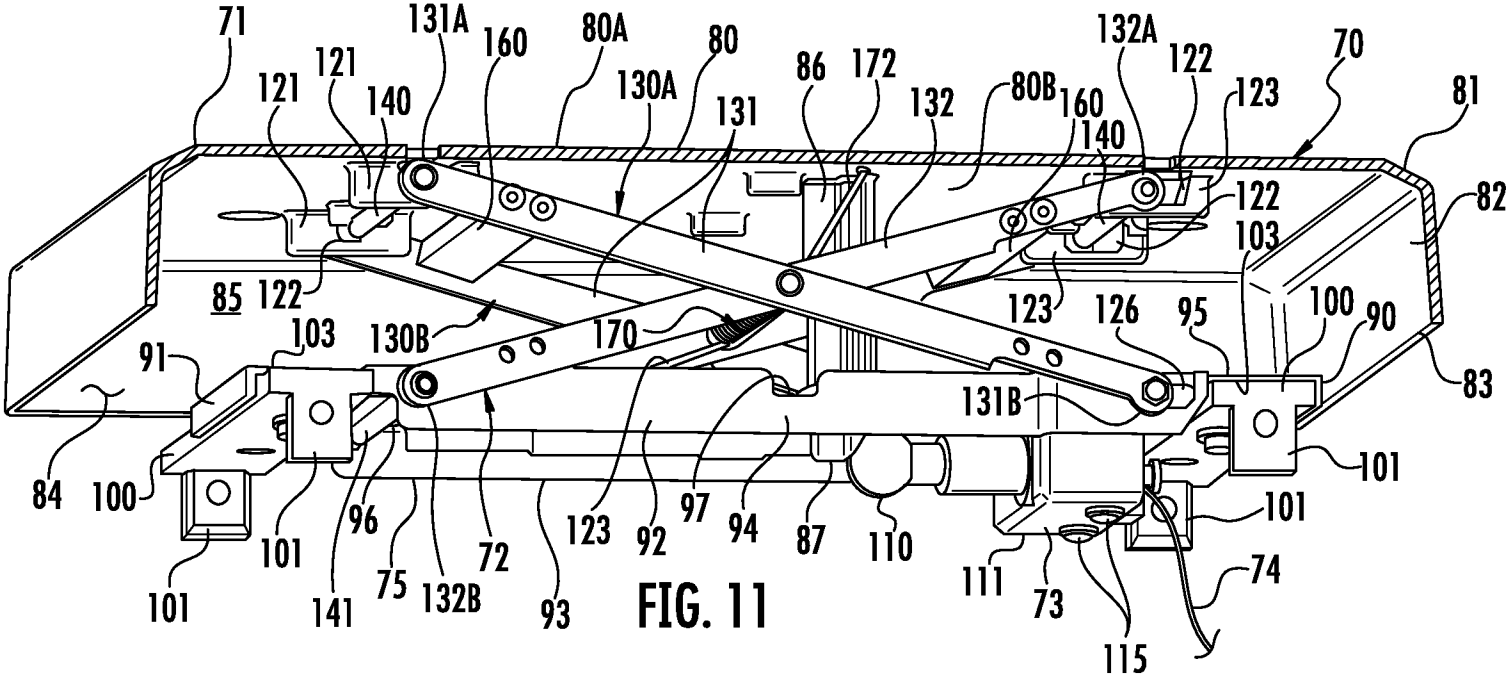
FIG. 11 is a bottom perspective view of the embodiment of FIG. 10.
Figure 12:
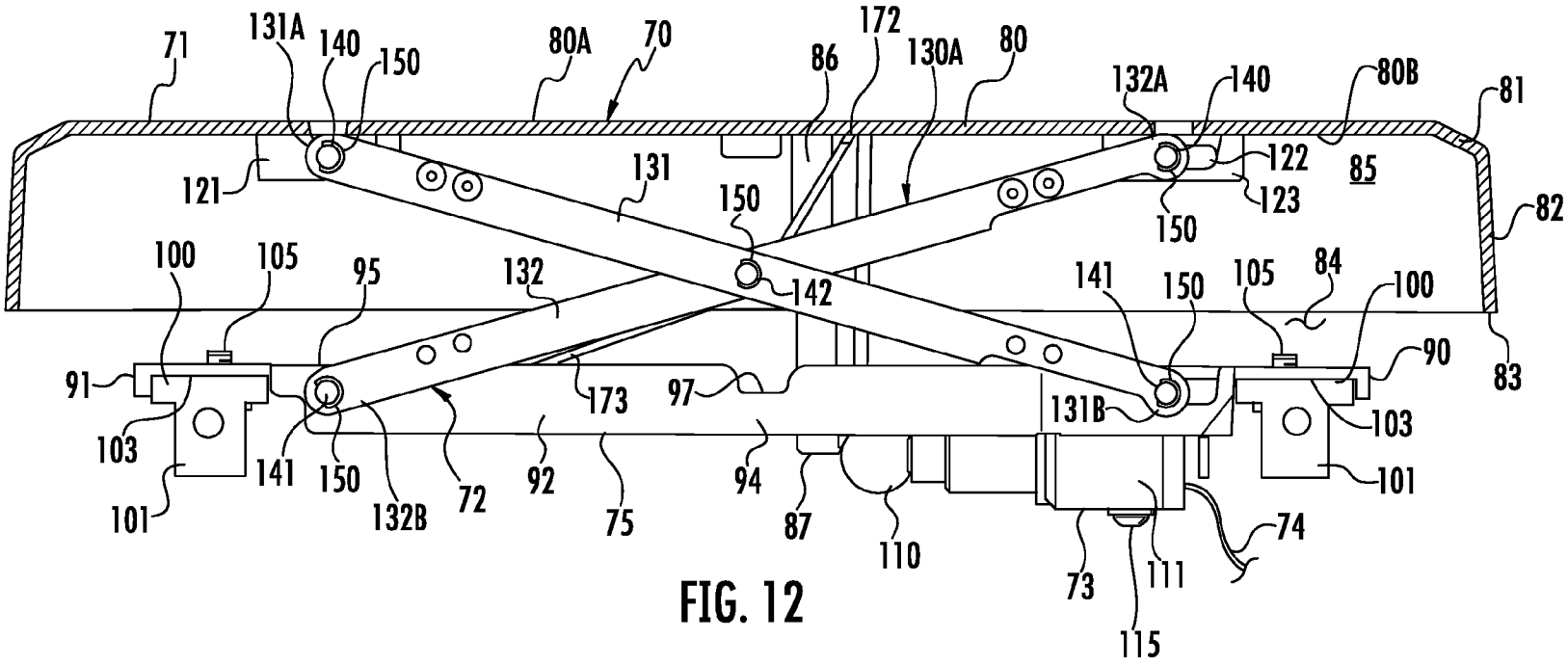
FIG. 12 is a side elevation view of the embodiment of FIG. 10.

Tag end 172 not only is directed upwardly toward upper ends 132A of elongate members 132 of scissor mechanisms 130A and 130B, tag end 172 is also directed upwardly toward and directly contacts inner face 80B of head 71 as shown in FIG. 11. Tag end 173 not only is directed oppositely and downwardly toward lower ends 132B of elongate members 132 of scissor mechanisms 130A and 130B, tag end 173 is also directed downwardly toward and directly contacts top side 95 of base 75. The direct contact of tag end 172 to inner face 80B of head 71 constitutes a coupling of tag end 172 of spring 170 to head 71, and the direct contact of tag end 173 to top side 95 of base 75 constitutes a coupling of tag end 172 of spring 170 to base 75. The coupling of tag end 172 of spring 170 to head 71 and the coupling of tag end 173 of spring to base 75 causes spring 170 to act between head 71 and base 75 biasing head 71 away from the safe position of head 71 toward base and toward the neutral position of head 71 away from base 75, whereby coils 171 of spring 170 wind and unwind in response to movement of head 71 between its raised neutral position and its lowered safe position relative to base 75. Thus, spring 170 acts between head 71 and base 75 applying a bias to head 71 tending to bias head 71 from the lowered safe position of head 71 defining the safe configuration of collision control apparatus 70 to the raised neutral position of head 71 defining the neutral configuration of collision control apparatus 70.

The described bias applied by spring 170 attached to linkage assembly 72 and which is coupled between head 71 and base 75 tends to holds head 71 in its raised neutral position defining the neutral configuration of collision control apparatus 70 in the absence of a collision between head 71 and an overhead obstruction. In response to a contact collision of head 71 with an overhead obstruction in response to movement of lifting mast 51 in the lifting direction sufficient to overcome the bias applied to head 71 by spring 170, the bias applied to head 71 by spring 170 is overcome causing head 71 to move/displace from the neutral position of head 71 defining the neutral configuration of collision control apparatus 70 to the safe position of head 71 defining the safe configuration of collision control apparatus 70. In this embodiment, spring 170 applies a force of approximately two pounds against head 71 to hold head 71 in its neutral position. The force of the impact of head 71 with an overhead obstruction sufficient to overcome the bias applied by spring 170 is thus only about two pounds. As such, the amount of force applied to head 71 sufficient to overcome the bias applied by spring 170 to cause head 71 to move/displace from the neutral position of head 71 defining the neutral configuration of collision control apparatus 70 to the safe position of head 71 defining the safe configuration of collision control apparatus 70 is a low amount of force representing a soft impact of head 71 with an overhead obstruction at issue. In other words, in the present embodiment it takes only about two pounds of force applied to head 71 to overcome the low/soft bias of spring 170 to result in the movement/displacement of head 71 from the neutral position of head 71 defining the neutral configuration of collision control apparatus 70 to the safe position of head 71 defining the safe configuration of collision control apparatus 70.

In response to removing the applied force to head 71, the bias applied by spring 170 is responsive and moves head 71 from its lowered safe position to its raised neutral position so as to reset head 71 back into its raised neutral position. The elongation of openings 122 of head 71 and openings 126 of base 75 not only accommodates the lengthening and shortening of linkage assembly 72 in response to movement of linkage assembly 72 between its extended and collapsed positions, but also constrains movement of linkage assembly 72 between its extended and collapsed positions so as to, in turn, constrain movement of head 71 between its neutral and safe positions. Channel 97 formed in base 75 opposes central connecting rod 142 extending between the middles 131C and 132C of the elongate members 131 and 132 of scissor mechanisms 130A and 130B and the coils 171 portion of spring 170 applied to central connecting rod 142 and receives and accommodates connecting rod 142 and the coils 171 portion of spring 170 in the collapsed position of linkage assembly 72 corresponding the lowered safe position of head 71 that, in turn, corresponds to the safe configuration of collision control apparatus 70.

In sum, collision control apparatus 70 consists principally of head 71, base 75 removably coupled to top 53 of lifting mast 51 of lifting device as shown in FIG. 105, linkage assembly 72 interposed between head 71 and base 75 coupling head 71 to base 75, and switch 73 attached to base 75. Collision control apparatus 70 extends upwardly from top 53 of lifting mast 51 from base 75 removably coupled to top 53 of lifting mast 51 to linkage assembly 72 and then to head 71, which is located over top 53 of lifting mast 51 and which is held by linkage assembly 72 so as to be horizontal with respect to top 53 of lifting mast 51. The conventional scissor architecture of linkage assembly 72 as herein specifically described holds head 71 horizontally with respect to top 53 of lifting mast 51 and maintains head 71 in this horizontal configuration while linkage assembly 72 articulates between its collapsed and extended positions. In response to a contact collision of head 71 with an overhead obstruction in response to movement of lifting mast 51 in the lifting direction sufficient to overcome the bias applied to head 71 by spring 170, the bias applied to head 71 by spring 170 is overcome causing head 71 to move/displace from the neutral position of head 71 defining the neutral configuration of collision control apparatus 70 to the safe position of head 71 defining the safe configuration of collision control apparatus 70. In response to movement of head 71 from its raised neutral position as shown in FIGS. 4, 7, 9-14, to is lowered safe position as shown in FIGS. 5, 21, and 22, abutment 86 is driven downwardly toward base 75 and switch 73, and encounters and is driven against plunger 100 depressing plunger 110 from its extended position to its depressed position as shown in FIGS. 21 and 22 activating switch 73. In response to removing the applied force to head 71, such as by moving lifting mast 51 in the lowering direction away from the overhead obstruction, the bias applied by spring 170 is responsive and moves head 71 from its lowered safe position to its raised neutral position so as to reset head 71 back into its raised neutral position. In response to movement of head 71 from its lowered safe position as shown in FIGS. 21 and 22 to its raised safe position as shown in FIGS. 4, 7, 9-14, abutment 86 is driven upwardly away from base 75 and switch 73, and is driven upwardly away from plunger 110 un-depressing plunger 110 permitting plunger 110 to move from its depressed position to its extended position deactivating switch 73.

And so in the raised neutral position of head 71, collision control apparatus 70 is in its neutral configuration and switch 73 is deactivated enabling the lifting and lowering circuits of drive assembly 55 thereby fully enabling drive assembly 55 in the normal operation of lift device 50 for moving of lifting mast 51 in the lifting direction indicated by arrowed line A in FIG. 1 to the lifting, lifted, or raised position of lifting mast 51 shown in FIGS. 17-20 and the lowering direction indicated by arrowed line B in FIG. 1 to the lowered position of lifting mast 51 shown in FIGS. 1-3 as shown in FIGS. 1-4, 17, and 18 for lifting and lowering equipment or material or other load applied to support platform 57 in the normal operation of lift device 50. Again, in the neutral configuration of collision control apparatus 70, drive assembly 55 is enabled to be operated from control panel 56 for moving lifting mast 51 in the lowering and lifting directions for lifting and lowering equipment or material or other load applied to support platform 57 in the normal operation of lift device 50. In the lowered safe position of head 71, collision control apparatus 70 is in its safe configuration and switch 73 is activated partially enabling drive assembly 55 by disabling the lifting circuit of drive assembly 55 to disable drive assembly 55 from moving lifting mast 51 in the lifting direction indicated by arrowed line A in FIG. 1 stopping movement of lifting mast 51 in the lifting direction while leaving the lowering circuit of drive assembly 55 enabled to enable drive assembly 55 to move lifting mast 55 in the lowering direction. Again, in the safe configuration of collision control apparatus 70, drive assembly 55 is enabled to be operated from control panel 56 for moving lifting mast 51 in the lowering direction for moving lifting mast 51 away from an overhead obstruction to thus permit lifting mast 51 to be withdrawn from an overhead object or obstruction, and drive assembly 55 is disabled to be operated from control panel 56 for moving lifting mast in the lifting direction to prevent damage to lifting mast 51 or to the load carried by support platform 57, which prevents an operator from operating the drive assembly 55 in the lifting direction that again could cause damage to lifting mast 51 and to a load carried by support platform 57.

The present invention is described above with reference to a preferred embodiment. However, those skilled in the art will recognize that changes and modifications may be made in the described embodiment without departing from the nature and scope of the present invention. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

The invention claimed is:

1. A method, comprising:

providing a lift device, the lift device includes a lifting mast having a top, a drive assembly for moving the lifting mast in lifting and lowering directions, and a head, the head is positioned above the top of the lifting mast and is mounted to the lifting mast for displacement between a neutral position away from the top of the lifting mast and a safe position toward the top of the lifting mast;

enabling the drive assembly for moving the lifting mast in the lifting and lowering directions, when the head is in the neutral position; and concurrently enabling the drive assembly for moving the lifting mast in the lowering direction and disabling the drive assembly from moving the lifting mast in the lifting direction, when in the safe position.

2. The method according to claim 1, further comprising biasing the head from the safe position to the neutral position.

3. A method, comprising:

providing a lift device, the lift device includes a lifting mast having a top, a drive assembly for moving the lifting mast in lifting and lowering directions, and a head, the head is positioned above the top of the lifting mast and is mounted to the lifting mast for displacement between a neutral position away from the top of the lifting mast and a safe position toward the top of the lifting mast;

operatively coupling a switch to the drive assembly and to the head; and the switch a) enabling the drive assembly for moving the lifting mast in the lifting and lowering directions, when the head is in the neutral position, and b) concurrently enabling the drive assembly for moving the lifting mast in the lowering direction and disabling the drive assembly from moving the lifting mast in the lifting direction, when in the safe position.

4. The method according to claim 3, further comprising biasing the head from the safe position to the neutral position.

* * * * *